US006070285A

United States Patent [19]

Geppert

[11] Patent Number: 6,070,285

[45] Date of Patent: Jun. 6, 2000

[54] PIPE CLEANING APPARATUS FOR OIL OR GAS PIPELINES

[75] Inventor: Christian Geppert, Bad Homburg, Germany

[73] Assignees: Shell E & P Technology Company, Houston, Tex.; Transglobal Ltd., Nassau, Bahamas

[21] Appl. No.: 08/895,929

[22] Filed: Jul. 17, 1997

[30] Foreign Application Priority Data

Jul. 18, 1996 [EP] European Pat. Off. ..... 96810471

[51] Int. Cl.[7] ..... B08B 9/04

[52] U.S. Cl. ..... 15/104.061; 15/104.05

[58] Field of Search ..... 15/3.5, 104.05, 15/104.061, 104.068

[56] References Cited

U.S. PATENT DOCUMENTS

| | | | |
|---|---|---|---|
| 4,388,871 | 6/1983 | Braithwaite . | |
| 4,494,584 | 1/1985 | Rognoni . | |
| 4,920,600 | 5/1990 | Reinhart . | |
| 5,617,604 | 4/1997 | Erich | 15/104.061 |

FOREIGN PATENT DOCUMENTS

| | | | |
|---|---|---|---|
| 5-245456 | 9/1993 | Japan | 15/104.061 |
| 0797804 | 1/1981 | U.S.S.R. | 15/104.061 |
| 1368053 | 1/1988 | U.S.S.R. | 15/104.061 |
| 0567658 | 2/1945 | United Kingdom | 15/104.061 |
| 1 280 102 | 7/1972 | United Kingdom . | |
| 9403285 | 2/1994 | WIPO | 15/3.5 |

*Primary Examiner*—Randall E. Chin
*Attorney, Agent, or Firm*—Townsend and Townsend and Crew LLP

[57] ABSTRACT

The invention shows pipe cleaning apparatuses for oil and gas pipelines in which a shield with a cleaning apparatus is moved forward by a liquid flow in the pipeline. The shield forms one or more apertures in the pipeline for a passing liquid flow in order to build up a predetermined pressure and is provided at its rear end with a braking apparatus which prevents undesirably large speeds of advance in that at least one clamping element adheres momentarily to the pipe wall and moves relative to the braking apparatus. This movement is kinematically transmitted to a hydraulic displacer which produces a secondary liquid flow that is braked via at least one throttle point and thus determines the speed between the shield and the pipe wall.

25 Claims, 16 Drawing Sheets

PIPE CLEANING APPARATUS FOR OIL OR GAS PIPELINES

BACKGROUND OF THE INVENTION

The invention relates to a pipe cleaning apparatus for oil and gas pipelines having deposits for example in the form of paraffins, which apparatus is pushed through the pipeline by a liquid flow for cleaning purposes, with the apparatus having a shield that forms one or more apertures for a passing liquid flow in order to form a predetermined flow resistance in the pipeline, wherein the shield is coupled to a braking device and can have a cleaning apparatus on its front side.

Depending on the forwarding region, solids and viscous products such as for example paraffins tend to deposit on the walls of oil and gas pipelines. Pipes of this kind clog up particularly rapidly when they are laid in cold surroundings such as for example at the bottom of the sea for offshore forwarding. In a case of this kind an attempt is presently being made to cleanse the pipes mechanically with a pipe cleaning device which is moved along by the pipe flow as long as they are not completely clogged. This type of pipe cleaning, or "pigging", is solved only incompletely, since it must be used over long distances, i.e. over several miles. The devices often get stuck in the deposits and the cleaning head fails to function. The only remedy is then to cut out sections of pipes and clean them with drill rods, which is an extremely costly endeavor for pipelines that are laid on the ocean floor, considering that the sections of pipe must be welded together again after cleaning.

Oil companies and suppliers are thus attempting to develop pipe cleaning apparatuses which can be transported along by a liquid flow over long distances without cable or pipe connections of any kind, where the liquid flow can be opposed by a pressure of 40 to 60 bar. Thus a brochure of GIRARD INDUSTRIES INC., 6531 North Eldridge Pkwy, Houston, Tex. 77041-3507 from the year 1994 shows so-called "cleaning pigs" which consist of two plate-like plastic disks between which cleaning brushes pressing radially outwards are mounted on a connecting piece. The entire structure is moved forward by a liquid flow in the pipe to be cleaned, and some embodiments can also be moved in both directions. The plate-like disks push and pull the brushes lying between them in order to scrape deposits off the pipe wall. The difference in pressure ahead of and behind the "cleaning pig" depends on the flow resistance of plates and brushes as well as on the friction of the plates and brushes against the pipe wall. Similar arrangements are offered by GIRARD in a brochure copyrighted 1988 as "F. H. Maloney Spring Loaded Pipeline Cleaning Pigs".

A similar device is proposed by the Shell Oil Company in U.S. patent application Ser. No. 08/396,807 of Mar. 2, 1995, now abandoned. The device consists of a sealing body on which a rotatably journalled cleaning head with nozzles is mounted in the direction of flow in order to remove solids, such as wax for example, from the pipe wall. A braking device is secured to the sealing body and has brake shoes which press radially against the pipe wall in order to thus brake the movement of the sealing body in the flow of the pipe and to build up a pressure difference. This pressure difference is used to provide the nozzles with a liquid jet via internal bypass lines and to set the cleaning head rotating.

Furthermore, the U.S. Pat. No. 4,920,600 shows a pipe cleaning apparatus which consists of a cleaning head with scrapers which broaden radially opposite to the direction of flow. The cleaning head is axially firmly secured to a carrier body which is executed as a pipe plug and has two sealing plates, each of which consists of a plurality of mutually movable elements in order to transmit pressure blows driven by the flow to the cleaning head.

A disadvantage of the devices listed here consists in the fact that they are restricted to thin encrustations and deposits, since they simply get stuck in thicker layers of deposits. Furthermore, the thickness of the deposits to be encountered cannot readily be predicted. For this reason the use of such devices is always associated with a high risk of getting stuck and incurring the cost and effort of separating out sections of pipeline.

SUMMARY OF THE INVENTION

It is an object of the invention to provide a reliable pipe cleaning apparatus for oil and gas pipelines. This object is attained by providing the braking device coupled to an apertured plate of the pipe cleaning apparatus with at least one clamping element which momentarily adheres to the pipe wall and moves relative to the braking device in order to displace a secondary liquid with this movement, which is braked via at least one throttle point and thus determines the relative speed between the shield and the pipe wall.

By means of this arrangement it is ensured that the pipe cleaning apparatus does not move in the axial direction at elevated speeds of advance, at which a clogging of the cleaning head can take place, and that the advancing movement can be compulsorily and autonomously performed. During this the braking energy is transferred by throttling to a secondary liquid flow, which heats the pipe cleaning apparatus and transmits the heat via the device to the passing liquid flow and to the surroundings.

A further advantage consists in the fact that a part of the braking forces is coupled to the speed of advance in such a manner that, as the speed of the pipe cleaning apparatus in the pipeline increases, the braking force also increases. It is therefore sufficient to regulate the liquid flow at the entry into the pipeline with a control system to a constant liquid flow in order to obtain the same conditions for the braking to a predetermined speed of advance and for the actuation of the cleaning apparatus everywhere along the pipeline. Because the apertures in the shield and the cleaning head for a passing liquid flow are fixed, a predetermined pressure difference can be maintained across the shield with a given braking force coupled to a speed of advance. Since, in the present case, the braking force depends on the speed of advance of the shield with respect to the pipe wall in accordance with a rising characteristic curve, a predetermined pressure difference sets in for a predetermined speed of advance when the friction conditions at the pipe cleaning apparatus remain approximately constant. With such an arrangement it is thus possible to choose the pressure difference across the shield to be so large that nozzles can be supplied thereby which already decompose the deposits at a distance ahead of the shield into transportable lumps or shavings in the manner of water jet cutting. Because the speed of advance is limited to low values in spite of the relatively large pressure difference across the shield, nozzle jets can cut away the deposits down to the base of the pipe wall due to the low speed fluctuations.

The braking force is composed of the following three possible components: Possible processing forces at the cleaning head ahead of the shield, the sum of the sliding friction forces between the pipe cleaning apparatus and the pipeline opposite to the direction of advance; and at least one partial braking force coupled to a certain speed of advance.

While the processing forces and the sliding friction forces and their fluctuations represent perturbation values, the partial braking force, which depends on the speed of advance, compensates the fluctuations in the first two in accordance with its throttling characteristics, in which the pressure force and the speed of advance are coupled. The smaller the perturbation values turn out, the more nearly constant will be the speed of advance. An approximate dependence of the partial braking force on the square of the speed of advance can be generated in accordance with an at least temporarily attained throttle characteristic in the secondary liquid flow. This over-proportional dependence means that large differences in the partial braking force can be produced with relatively small changes in the speed of advance in order to compensate for perturbations.

Lower perturbation values in the braking force also arise in a pipe cleaning apparatus without mechanically scouring cleaning elements. Thus in an arrangement of nozzles that cuts with liquid jets, the only impulsion forces arising are those which are produced through deflection of the jets. However, these forces remain constant, so that practically only the fluctuations of the sliding friction forces still have to be compensated through a change of the partial braking force, which, as described above, leads to only small changes in the speed of advance.

For the function of the braking device, the clamping element which determines the speed of advance as a result of the force to be compensated must be connected as securely as possible, i.e. without slip, to the pipe wall. Therefore a radial force must be produced between the clamping elements and the pipe wall which is sufficient to achieve a momentary adhesion of the contact surface of a clamping element. Since the pressing against the contact surfaces cannot be increased without limit on account of impermissible deformations at the inner pipe wall, and since limits are also placed on the production of large constant radial forces by fluctuating inner pipe diameters, it is advantageous to use a plurality of braking devices connected to one another. This enables large pressure differences to be produced at the shield such as are for example required for the cutting of deposits with liquid jets.

A first possibility consists in executing clamping elements as co-moving rollers which are pressed radially against the pipe wall and in turn displace a secondary liquid in predetermined volumes with their rotation in order to brake the thus arising secondary liquid flow with throttles. Thus a roller can for example act as a thrust crank on hydraulic brake cylinders with throttle points or shock absorbers respectively, with a compensation of the fluctuating force/path characteristics of the individual thrust cranks taking place through the use of a plurality of rollers and of a plurality of shock absorbers on each roller.

A further possibility consists in having the roller drive a volumetric pump such as for example a vane cell pump whose volume flow is braked via throttles.

A further possibility consists in using a displacement pump which is executed as a multiple piston pump. The pistons are arranged in star-like manner in a first part (radial piston pump) which rotates with the roller and are guided during their rotation radially along a waveline in order to suck secondary fluid out of a low-pressure line and to expel it into a high pressure line, with two non-return valves being provided in each case.

Constructional limits are soon reached if co-moving braking rollers are used in pipelines with diameters of a few inches. A roller has the advantage that it can overcome obstacles such as welding joints or fluctuations in the diameter of the pipeline as long as it is correspondingly yieldingly journalled. On the other hand, the greatest possible radial pressing force should be exerted by the roller and its rotation transformed via a kinematic chain into displaced volume of a secondary liquid. Both requirements constructionally require a relatively large amount of space in the pipeline. It has thus proved advantageous to use a gas reservoir as a soft yet strongly pre-biased spring element which can be mounted at a spatial displacement from the roller and which acts with its pressure on a high pressure cylinder that exerts a radial force on the roller. Because a liquid medium is used in the high pressure cylinder, the leakage losses at the cylinder can be kept small.

A further requirement on the points of application of the braking forces would be that the radial forces do not exert a tilting torque which could effect a tilting of the supporting housing parts of the pipe cleaning apparatus. It would be ideal if the radial forces would cancel each other in their respective planes perpendicular to the longitudinal axis. Theoretically it would thus be necessary to arrange at least two oppositely disposed rollers in a cross-section. In practice, however, it has proved more sensible for reasons of space to provide a sliding shoe at the pipe wall opposite to a roller which slides along the pipe wall and is pressed outwards with a radial force equal to yet opposite to that of the roller. Experiments have shown that only insubstantial fluctuations in the size of the sliding frictional force arise with a cambered sliding shoe of abrasion resistant material in the relatively low range of speeds of advance under consideration. This has the advantage that a portion of the required braking force can be produced via approximately constant sliding friction, and the braking device can be dimensioned correspondingly smaller in the secondary liquid region. It is clear that the radial pressing force may only be chosen to be sufficiently large that the roller determines the speed of advance with its partial braking force.

For an arrangement of this kind it has proved advantageous for the radial pressing force to have a component which is proportional to the pressure difference over the pipe cleaning apparatus. A requirement of this kind is elegantly satisfied design-wise in that the radial contact pressure force is produced via hydraulic pistons which are exposed to the high pressure of the secondary fluid upstream of the restrictor, and in that a reservoir for the secondary liquid is present at the low pressure side of the secondary liquid which has, in addition to a pressure component produced by a spring, a pressure component which is generated by the pressure difference over the pipe cleaning apparatus. In this manner a radial contact pressure of the braking device is first achieved by this spring generated pressure component, i.e. of the roller and the sliding shoe. The displacement pump is driven by the roller which is pressed into contact and generates, with increasing speed of rotation, a high pressure which is restricted by the restrictor and which simultaneously acts on the radially pressing hydraulic pistons. With a reasonable matching of the piston areas to the pressure generated by the pump and the restrictor, radial contact pressure forces arise which are so large that the roller does not slip at the pipe wall and which, on the other hand, are not so large that the braking device is blocked via the sliding shoe.

A further embodiment of a braking apparatus with controlled speed of advance consists in using two axially displaced clamping elements step-wise whose radial forces cancel each other in the respective cross-section and in limiting the stroke of the momentarily engaged clamping element in the axial direction with a piston which moves a secondary, throttled liquid flow, while the second, momentarily non-clamping element is moved into an initial position which moves a secondary throttled liquid flow on changing the clamping at the second element. Here it is sensible, when changing the clamping, to provide an overlap of the clamping times in order that no uncontrolled sliding can take place. The procedure is then such that a standstill occurs at the end of the braked stroke for the first clamping element, upon which the clamping of the second clamping element in its initial position takes place. When the clamping of the second clamping element has taken place, the clamping of the first clamping element is discontinued, for example via a pressure switch; the pipe cleaning apparatus is retained only by the second clamping element and makes an axial advancing movement with respect to the second clamping element during the relative stroke with controlled, approximately constant speed. The movement of the pipe cleaning apparatus in the pipeline is then practically a stepwise one and is like that of an acrobat who lowers himself along a rope without crossing or sliding his hands, This comparison also shows at the same time how difficult it would be to maintain a constant speed of advance through radial pressing and sliding friction alone.

In principle any kind of cleaning head can be mounted on a shield with the braking apparatuses described here and improved in its operation through the limitation of the speed of advance achieved.

Simultaneously with the approximately constant advance, however, a predeterminable pressure difference across the shield is also provided, which enables hydraulic motors to be provided for auxiliary drives—whether it be to drive pressure amplifiers for the braking device or mechanical drives for a cleaning device.

With a large pressure difference across the shield a new concept for a cleaning apparatus directly at the shield can be realized for the braking devices described here as well as for other types in general. An impact grid mounted on a central securing arm and arranged transverse to the pipe axis is dimensioned somewhat smaller than the anticipated free core of the dirty pipeline and is pushed forwardly in advance of the shield. Nozzles with different jet directions are arranged in the shield itself, some of which are directed towards the pipe wall between the impact grid and the shield in order to detach the contamination in the form of lumps and shavings. Other jets are directed towards the impact grid in order to swirl the arising lumps and shavings, to knock them into smaller pieces at the impact grid and to convey off these pieces ahead of the impact grid with the passing liquid flow in the free core of the dirty pipeline. As a rule the nozzles and their jets also have a forwardly directed component in order to keep the shield free from contamination. If the nozzles are distributed over circles concentric to the pipe axis, a uniform cutting pattern which is independent of the angle of rotation can be produced in the deposits on the pipe wall. It is advantageous in particular for the shield to have a protruding ring with a large number of nozzles near the pipe wall for detaching residual deposits in order to cut free the path for the shield. Here the nozzle jets can also have a substantial component in the peripheral direction in order to cut transversely to the direction of advance and at an acute angle to the pipe wall. If the sum of the moments of the impulses from the nozzles on the shield and the cleaning head largely cancel each other, the coupling part between the shield and the braking device is subject to less torsional stress.

Since oil and gas pipelines also have curvatures with radii of curvature corresponding to a few pipe diameters, above all where they start and end, pipe cleaning apparatuses are also assembled of several parts which are movable with respect to one another and connected to one another via couplings. Such couplings must be capable, through their arrangement and design, of taking up the deflections when travelling around a curve. As soon as the couplings are subjected to pressure in the axial direction when passing through pipe bends, there is an increased risk that the parts will get wedged in the pipe. It is therefore advantageous for a certain tensile stress to be always present between the parts of a pipe cleaning apparatus. For a pipe cleaning apparatus having a shield as its most forward part and an effective braking device as its hindmost part, this condition is fulfilled as long as the shield does not encounter too great an obstacle. In such a situation of a stuck pipe cleaning apparatus, it is advantageous for the functions of the parts to be interchanged by a reversal of the liquid flow, i.e. by a feeding in from the other end of the pipeline. For this purpose a return trip shield is arranged at the last part, which forms a substantially greater flow resistance when the flow is reversed, and a sort of reverse flow device, for example a non-return flap, is provided in the original shield which frees an additional passage area in the case of a reversed direction of flow. Since no limitation of the speed is required for the backwards motion in the already cleaned pipe, and a braking device which is still effective would rather tend to produce a wedging between the braking device and the shield, it is sensible to discontinue the effect of the braking device, which can be triggered for example by the release movement of the return mechanism at the shield.

Flaps such as are found in a "butterfly" valve can for example be provided as a return trip shield, with the flap vanes being released into the open position only after reversal of the flow, for example together with the discontinuation of the braking action, in order to exclude with certainty a mechanical blocking during the forward movement.

BRIEF DESCRIPTION OF THE DRAWINGS

The invention will be described in the following with reference to the exemplary embodiments illustrated in the following drawings.

DESCRIPTION OF THE PREFERRED EMBODIMENTS

The figures show pipe cleaning apparatuses for oil and gas pipelines in which a shield with a cleaning apparatus is moved forwards in the pipeline by a liquid flow. The shield forms one or more apertures in the pipeline for a passing liquid flow in order to build up a predetermined pressure and is provided at its rear end with a braking device which prevents undesirably large speeds of advance in that at least one clamping element adheres momentarily to the pipe wall and moves relative to the braking device. This movement is kinematically transmitted to a hydraulic displacer which produces a secondary liquid flow which is braked via at least one throttle point and thus determines the speed between the shield and the pipe wall.

Figure 1:
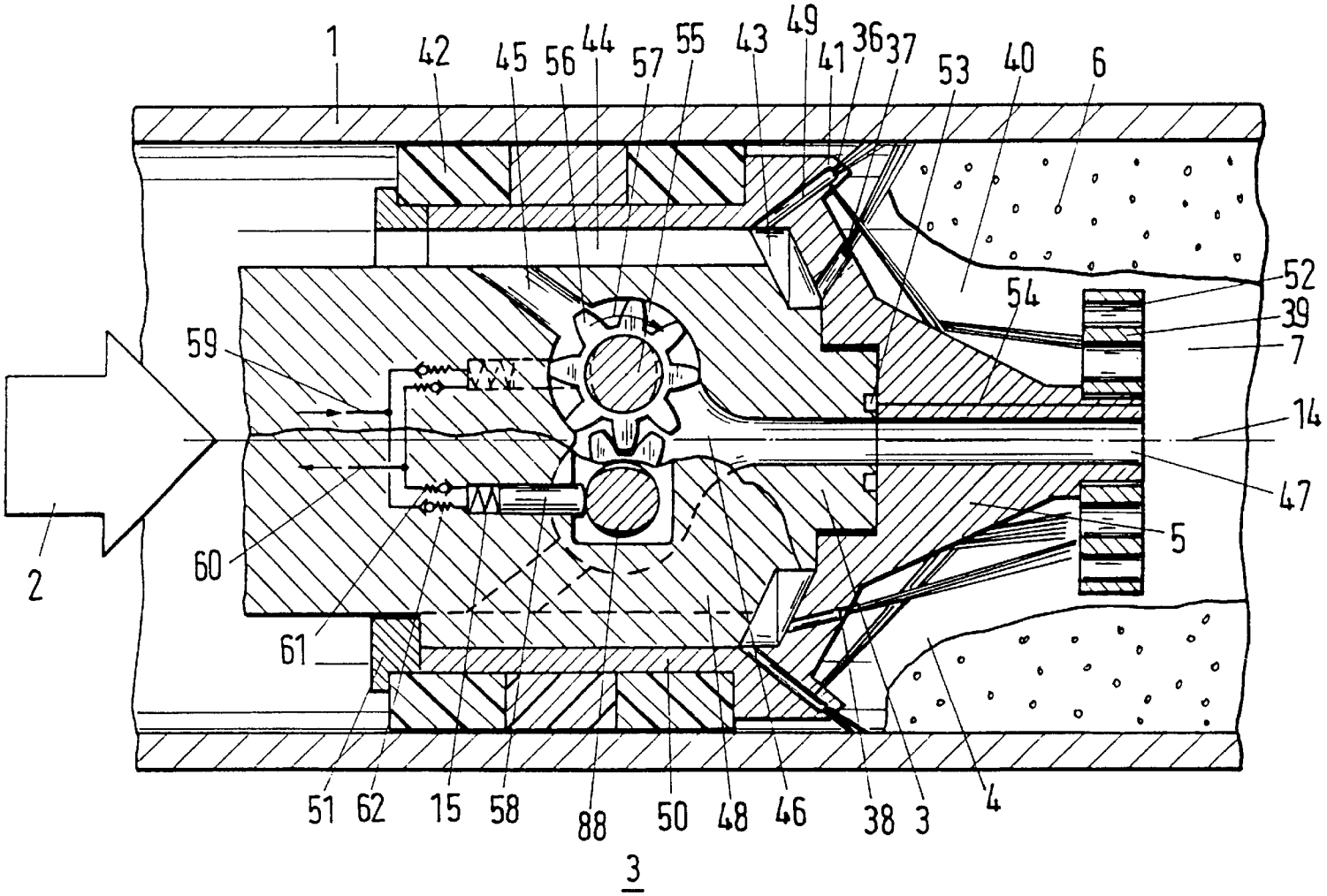
FIG. 1 is a schematic view of a shield with a cleaning head which can be used for various braking apparatuses, with a hydraulic motor being additionally provided in the shield as a drive for setting members in the cleaning apparatus.

FIG. 1 shows a shield 3 with a cleaning apparatus 5 which is for example coupled in accordance with FIGS. 2 to 7 to braking devices 8 which limit its speed of advance. In a pipeline 1 a liquid flow 2 drives the shield 3 ahead of it, the outer housing 50 of which is sealed against the pipeline 1 by the packings 42 and simultaneously guided. The packings 42 are secured by a holder 51. Apertures 45, 46, 47; 44, 43, 49, 36, 37, 38 exist over the shield which permit the passage of a liquid flow 7 and build up a pressure of for example 30 bar against the liquid flow 2 at a predetermined speed of advance of the shield 3. This pressure can be built up at the shield 3 independently of the location of the shield in the pipeline if the liquid flow 2 at the input end is regulated to constant amount.

In the inner housing 48 a hydraulic motor 55, which is formed with gears 56 and with cam discs 88, acts as a pressure amplifier via a pump system 15 with a piston 58 and non-return valves 61, 62 on the suction and pressure lines 59, 60 of a hydraulic auxiliary system, which can for example be used to maintain the clamping force in radial clamping elements 9*a*, 9*b*. An inlet 45 and an outlet 46 are matched to one another in their cross-sections in such a manner that, for a predetermined pressure difference, the hydraulic motor 55 cannot rotate in excess of a given rotary speed in the direction of rotation 57.

The cleaning device 5 is integrated into the shield 3 at its front face 4. An impact grid 39 having bores 52 is mounted on an arm of the outer housing 50 concentrically to the pipe axis 14. The impact grid 39 has an outer diameter which is smaller than the inner diameter of the anticipated deposits 6 and forms—since it protrudes at a distance from the shield 3—a cavity 40 which is bounded by the pipe wall 1 and the non-removed deposits 6. Nozzles 36, 37, 38 are provided in the shield 3 and are supplied with a flushing liquid under pressure via connecting channels 44, a ring channel 43 and pre-bores 49. Some of the nozzles spray against the pipe wall 1 in order to cut away lumps and shavings of deposit 6 during the advancing movement of the shield 3. Other nozzles spray directly or indirectly into the cavity 40 in order to break down the lumps and shavings to sizes that are capable of passing through the impact grid 39 and in order to transport off the particles which move ahead of the impact grid 39 with the passing and displaced liquid flow 7. In this respect the small size of the particles is a good guarantee that no clogging will occur. Near the pipe wall ahead of the packings 42, the shield 3 has a ring 41 with nozzles 36 which remove possible residual deposits and cut the way free for the packings. A ring channel 53 is arranged between the inner housing 48 and the outer housing 50 and is connected via a connecting bore 54 to the space ahead of the impact grid 39. The ring channel makes the reference pressure available ahead of the impact grid 39 for the pressure actuated switching elements.

The principle and the constructional details of a braking device which can be combined with a shield in accordance with FIG. 1 are described in FIGS. 2*a*, 2*b*, 2*c*, 3*a*, 3*b*, and 4.

Figures 2A, 2B:
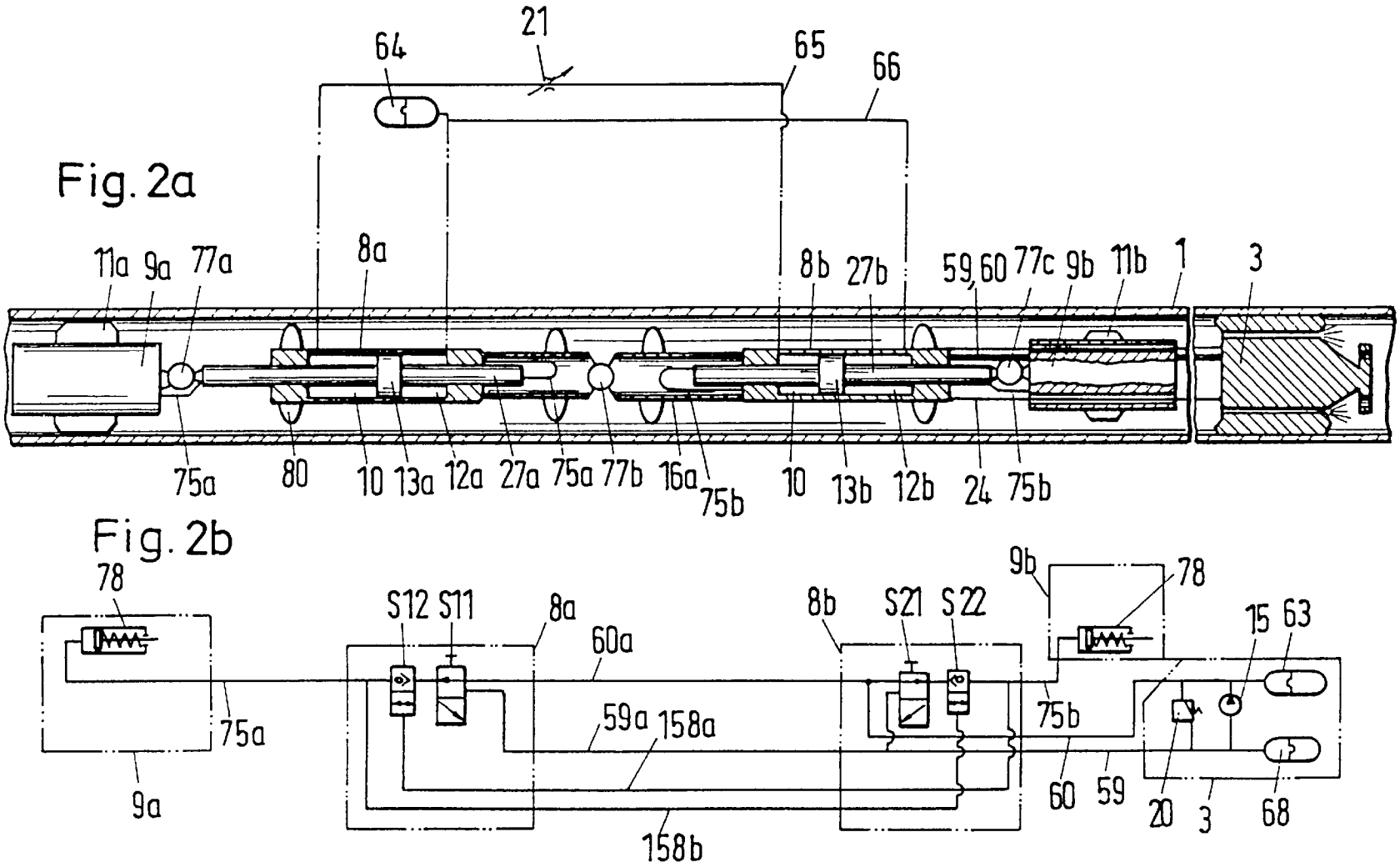
FIG. 2*a* is a schematic view of a pipe cleaning apparatus with a braking device which permits a stepwise controlled advance of a cleaning head.
FIG. 2*b* is a schematic view of a hydraulic circuit for the cooperation of clamping elements and brake pistons in FIG. 2*a;*

The principal arrangement of the elements can be seen in FIG. 2*a*. The internal piping 65, 66 with an adjustable throttle 21 for the braking of the secondary liquid 10 is drawn out in FIG. 2*b*, while FIG. 2*c* shows a hydraulic circuit for the clamping elements 9*a*, *b*. The clamping shoes 11*a* of the first clamping element 9*a* are pushed outwards in the pipe 1 and brake the shield 3 via the intervening braking device 8*a*, 8*b*. The force flow for the braking force proceeds from the clamping element 9*a* via a coupling 77*a* to the piston rod 27*a* and the piston 13*a* of the first braking device 8*a*. The secondary liquid 10 is displaced by the piston 13*a* via a throttle point 21 and moves the piston 13*b* of the second braking device 8*b* and also moves a second clamping element 9*b* during idling in the direction of advance via an associated piston rod 27*b* and coupling 77*c*. The actual braking movement is transmitted from the braking cylinder 12*b* and from there via draw members 24, e.g. wire cables, to the shield 3. Instead of pure draw members 24, it is also possible to use draw rods supported at pivot joints which can also transmit compressive forces within the framework of their buckling length. During this the clamping shoes 11*b* of the second clamping element 9*b* are drawn in. Guiding fins 80 are mounted on each of the housing parts and keep the housing parts approximately in the middle of the pipe. Leakage losses of the secondary liquid 10 can be compensated by a co-travelling pressure reservoir 64. Because the pistons 13*a, b* and the cylinders 12*a, b* have the same dimensions, the pistons attain their end positions practically simultaneously and indeed in such a manner that they lie closest together at one time and that they lie the farthest apart at the next time.

FIG. 2*c* shows a schematic hydraulic plan of the shield 3 with a pump system 15 and a pressure limitation valve 20. Pressure reservoirs 63, 68 supplement possible leakage amounts at the high pressure and the low pressure sides. The pressure line 60 and the suction line 59 pass, in the form of hydraulic hoses which are guided parallel to the draw members 24, from the shield 3 to the second braking device 8*b* and pass on further as branch lines 60*a*, 59*a* via the coupling 77*b* to the first braking device 8*a*, whose construction can be seen in FIG. 4. Switching valves S11, S12 as well as S21, S22 are mounted on each of the braking devices and, depending on the piston end positions, change over the clamping at the clamping elements 9*a* and 9*b* with an overlapping of the clamping so that no undesired slip arises with respect to the pipe wall 1.

Beginning with a position in accordance with FIG. 2*a*, the following valve positions result:

Switching valve S12 stands in the position permitting flow via the non-return valve, since the second clamping element 9*b* is at low pressure.

Switching valve S11 passes on the high pressure of pressure line 60*a*.

⇒ Clamping shoes 11*a* are extended under pressure.

Switching valve S22 stands in a position permitting flow in both directions since the first clamping element 9*a* is at high pressure.

Switching valve S21 passes on the low pressure of the suction line 59*a*.

⇒ Clamping shoes 11*b* are retracted.

When the end position is reached in which the pistons 13*a*, 13*b* stand the farthest apart, the following switching steps are carried out:

Switching valve S11 is reset to low pressure, which can however not yet be passed on since the pressure for switching S12 is absent. Clamping element 9*a* remains clamped.

Switching valve S21 is reset to high pressure and can pass on the high pressure to the clamping element 9*b* independently of the position of the switching element S22.

⇒ Clamping shoes 11*b* are extended and a high pressure builds up on fixation of the clamping shoes which now switches the switching valve S12 to passage in both directions.

⇒ Clamping shoes 11*a* are retracted.

The second clamping element 9*b* is now rigidly connected to the piston 13*b* in the axial direction. The shield 3, which is suspended from the second braking cylinder 12*b*, presses the secondary liquid back in the opposite direction via the throttle line 65 and simultaneously brings the first piston 13*a* back to its initial position. In this position a change of direction of the pistons 13*a*, 13*b* takes place just as described above with a brief "stop" during the overlapping clamping.

The shield moves in steps in this manner, with the speed being predeterminable by means of the throttle 21.

Figure 4:
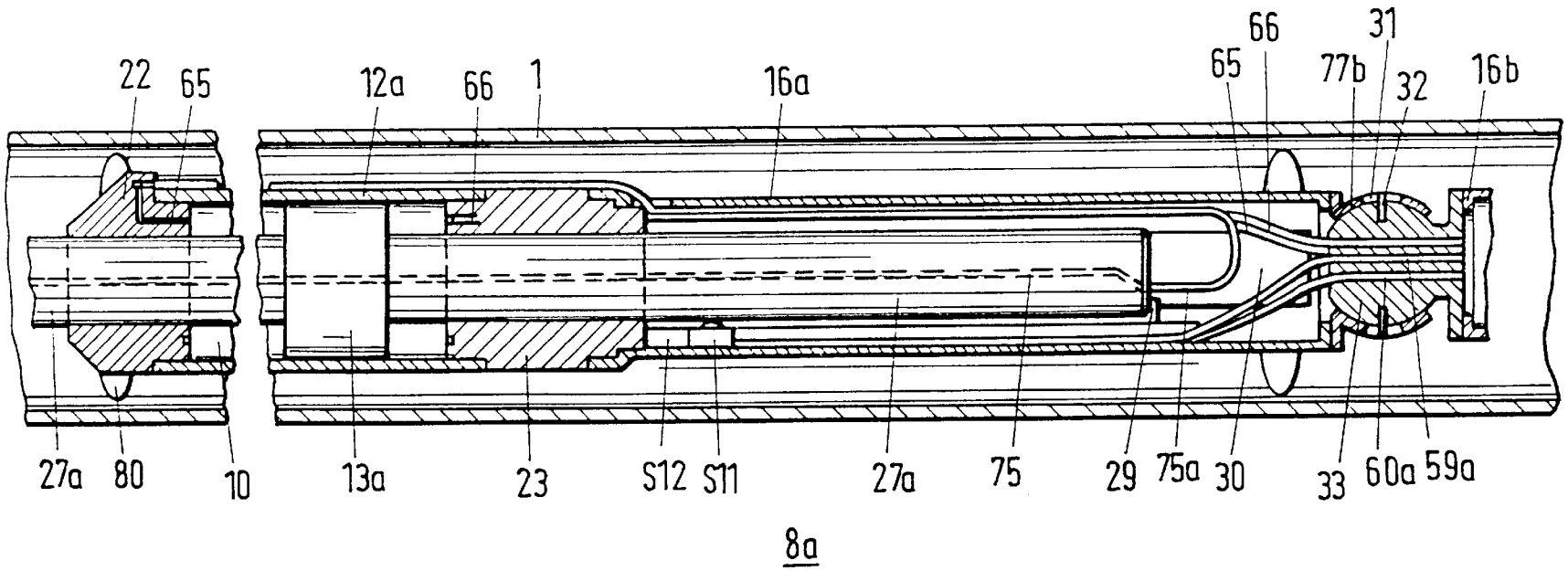
FIG. 4 is a schematic view of parts of a braking device in accordance with FIG. 2*a;*

FIG. 4 shows the spatial arrangement of the components of the braking device 8*a*. The braking cylinder 12*a* with the base 22 and the intermediate base 23, together with an intermediate piece 16*a*, forms a supporting housing for the remaining elements. In the intermediate piece 16*a* there are windows 30 which facilitate access and checking. A coupling 77*b* with a spherical body 33 and a socket connects the intermediate bodies 16*a*, 16*b* of the two braking devices 8*a* and 8*b*. The socket has elongate slits 31 which prevent a rotation of the coupling through pins 32 inserted into the spherical body 33. The spherical body 33 is dimensioned so large that hydraulic lines 65, 66, 59*a*, 60*a*, 158*a*, 158*b* can be passed through it. The permissible deflection of the axis between the socket and the spherical body 33 is limited in order not to expose the hydraulic hoses to undue stress. The switching valves S11, S12 are arranged at the transition to the intermediate base 23, with the switching valve S11 storing an end position in each case until the next end position is reached. The connection line 75*a* to the clamping element 9*a* is first led to the intermediate base 23 and then passes further as a hydraulic hose to the front end of the piston rod 27*a* and as a bore in the piston rod 27*a* up to the coupling 77*a*. In order to prevent an impermissible rotation of the piston rod 27*a* the latter can be guided along the intermediate piece 16*a* via a guide cam 29 at the end face.

The construction of the second braking device 8*b* with its clamping element 9*b* is analogous.

Figure 3A:
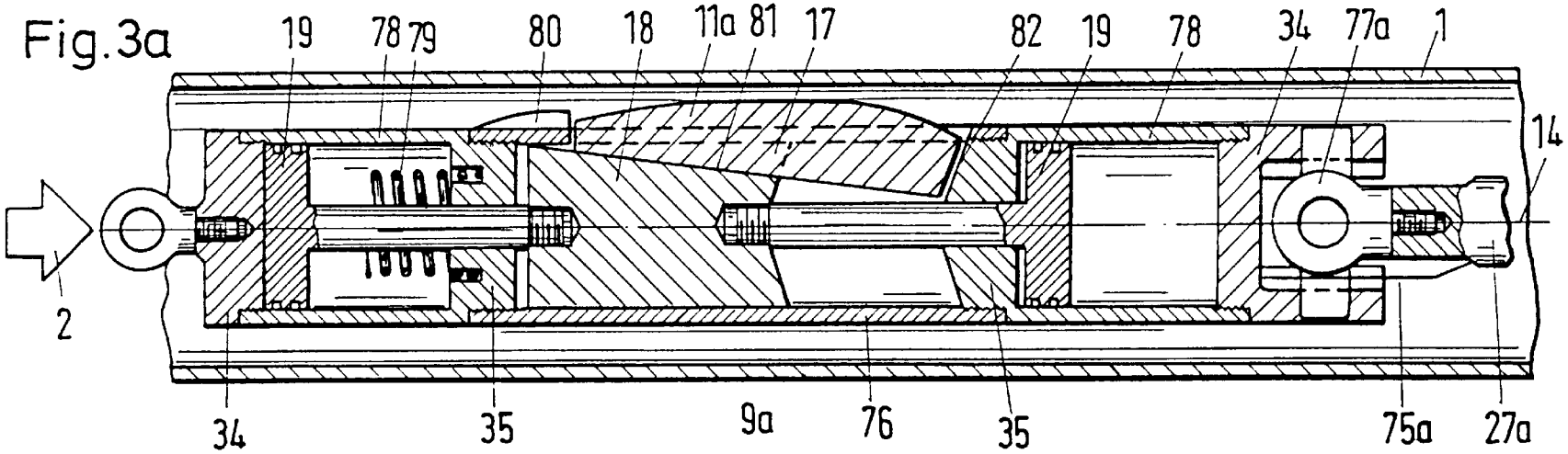
FIGS. 3*a, b* schematically illustrate embodiments of clamping elements in accordance with FIG. 2*a;*
Figure 3B:
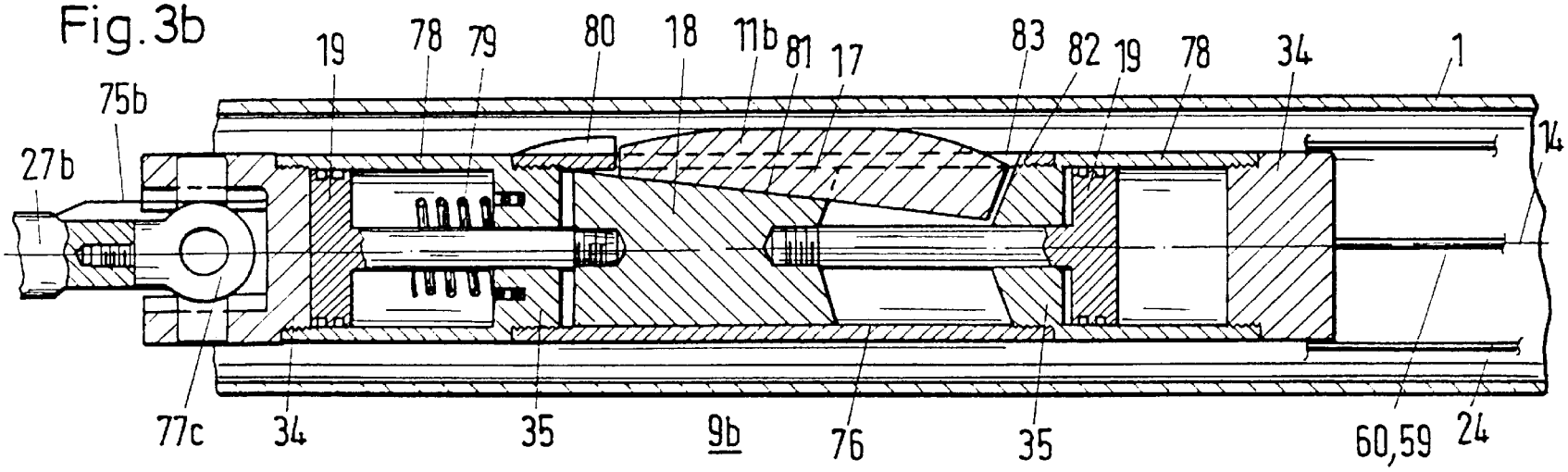

Clamping elements are shown in FIGS. 3*a*, 3*b*. The piston rods of the associated clamping pistons 19 protrude into the middle part 76 and act on a displacer body 18 with oblique surfaces 81. Sliding blocks 17 which are executed as clamping shoes 11*a*, 11*b* extend movably with respect to the oblique surfaces 81 and to the counter-surfaces 82 and protrude outwards through slits 83 through the contour of the middle parts 76. Bases 34 provide for the closure of the clamping cylinders 78. At low pressure a restoring spring 79 let into the cylinder head 35 effects a release of the clamping and the drawing in of the clamping shoes 11*a*, 11*b*. Here the clamping element 9*b* is passed at its outer side by the draw members 24 and the supply lines 60, 59. It would however also be possible to execute the piston rods as hollow piston rods journalled at both ends and to execute the pistons 19 with a larger central bore in order for example to accommodate therein a central push and pull rod which simultaneously accommodates the lines 59, 60.

Figure 5:
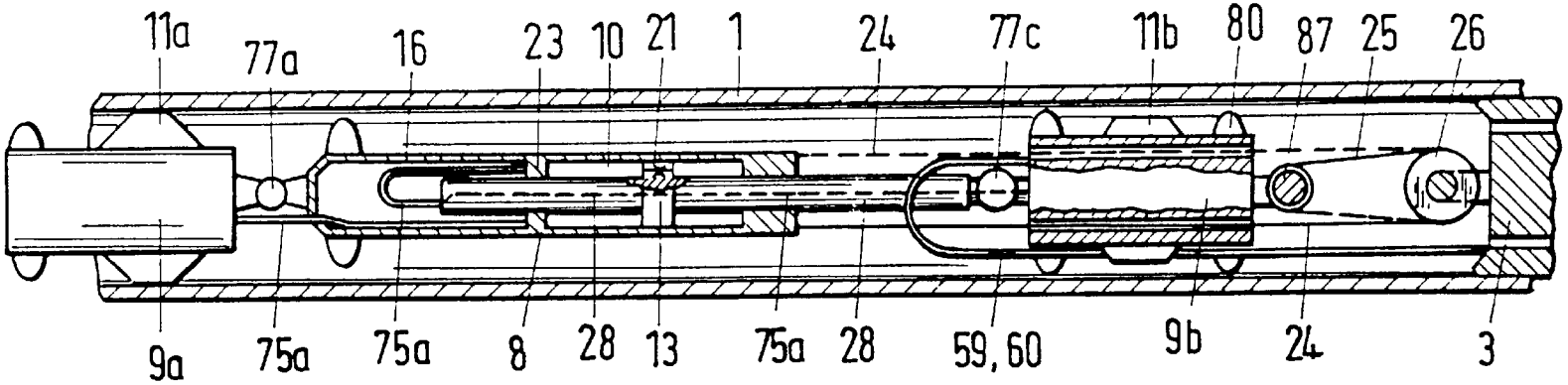
FIGS. 5, 6 are schematic views of a pipe cleaning apparatus with a braking device which is connected to the shield via a deflection roller and which permits a stepwise controlled advance via a single doubly acting piston.
Figure 6:
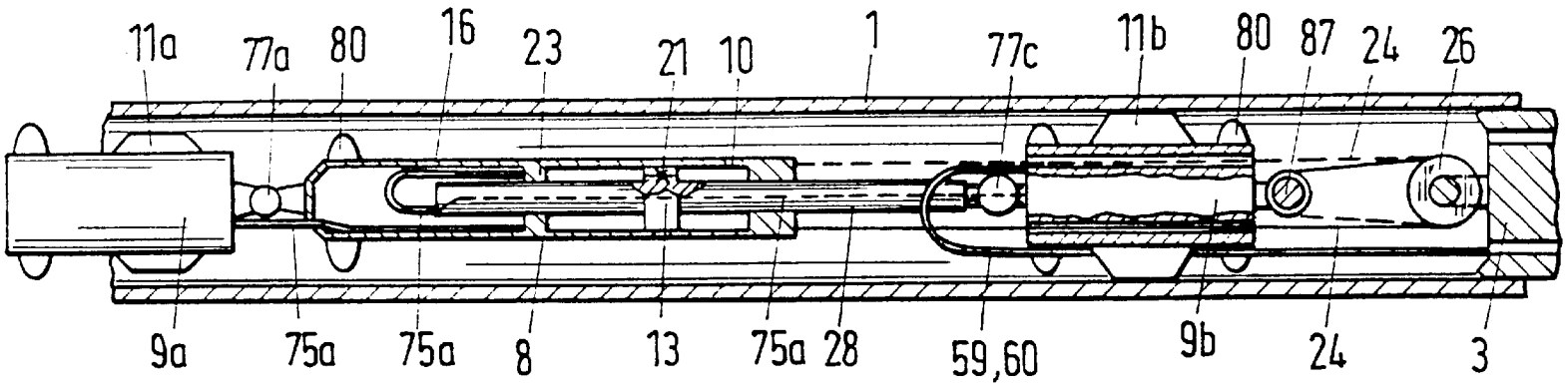
Figure 7:
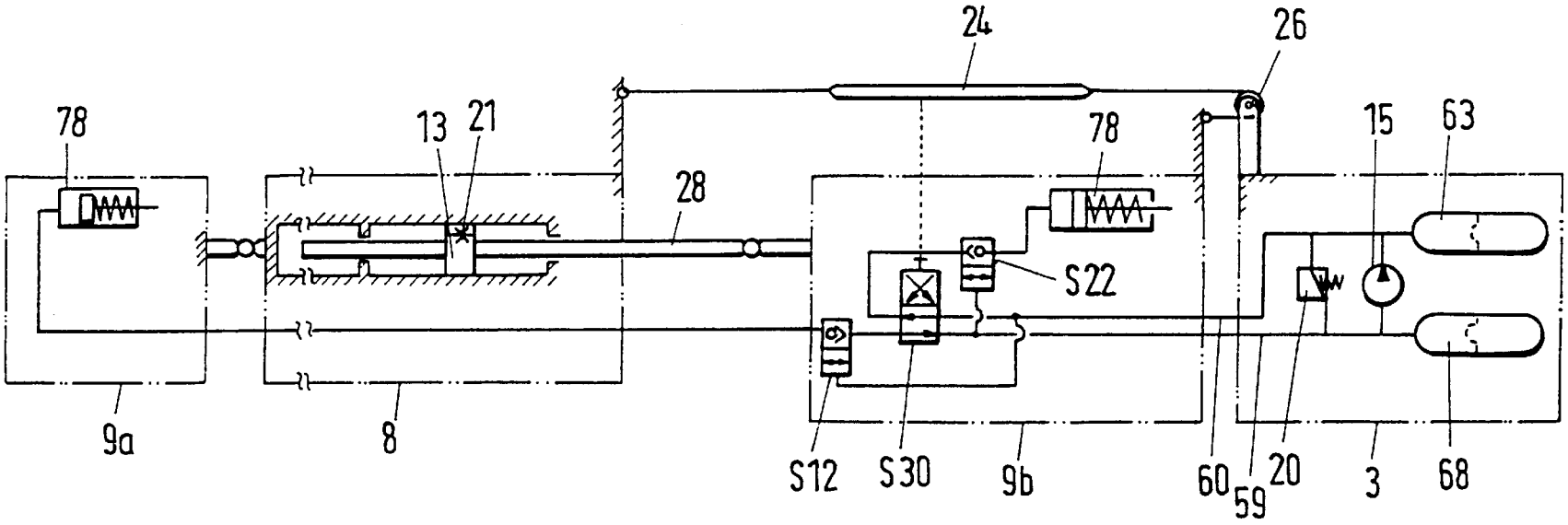
FIG. 7 is a schematic view of a hydraulic circuit for the clamping elements in accordance with FIGS. 5 and 6.

A further embodiment of a stepwise braking device is shown in FIGS. 5, 6 and 7 in which the braking device 8 has only one brake piston 13 with a piston rod 28 passing through both sides and with the displaced secondary liquid 10 being relaxed via a throttle point 21 at the piston 13. The draw members 24 (one shown as a broken line, one shown as a solid line) are fastened as flexible cables or bands to the braking device 8 and to the clamping element 9*b* and led in a loop 25 about a deflection pulley 26 on the shield 3. This has the result that the shield 3 executes only half of the relative movement between the housing of the braking device 8 and the clamping element 9*b*. In FIG. 5 the clamping element 9*a* clamps using clamping shoes 11*a* and blocks an intermediate piece 16 of the housing of the braking device 8 via a coupling 77*a* and thus the one end of the draw members 24, the other end of which produces a draw load via a deflection pulley 87 at the second clamping element. This pulling force pulls the piston 13 into a forward end position via the second clamping element 9*b* and via a coupling 77*c*, with the displaced secondary liquid 10 entering into the rear cylinder space via a throttle point 21, which can for example be built into the piston itself. This secondary liquid flow can just as well be conducted past at the outside of the cylinder via an adjustable throttle.

In FIG. 6 the clamping shoes 11*b* of the second clamping element 9*b* are extended, whereas the clamping shoes 11*a* of the second clamping element 9*a* are retracted. This has the effect that the piston 13 stands still relative to the pipe wall and that the shield 3 moves forward at half the speed of the housing 16. In this manner the piston 13 reaches the intermediate base 23 at the other end of the cylinder, while the secondary liquid 10 can be relaxed in the reverse direction via the same throttle point 21. An advantage of this arrangement consists in the fact that almost no tubing is required for the secondary liquid. The heat arising through the throttling is dissipated by the outer cylinder cover to the surroundings. A further advantage is that all switching valves S30, S12, S22 for the changeover of the clamping are accommodated on the second clamping element 9*b*. FIG. 7 shows a hydraulic plan in which a circuit is seen by means of which the changeover of the clamping takes place. A pump 15, a pressure limiting valve 20 and high pressure and low pressure reservoirs 63, 68 are accommodated in the shield 3 and are connected via lines 59, 60 to the second clamping element 9*b*. The connection is made via roll-off hydraulic tubes. A switching valve S30 measures off the end positions of the piston 13 indirectly at the draw member 24, with a changeover taking place each time an end position is attained, i.e. once an end position is reached it remains stored until the next one is reached. The supply line to the first clamping element 9*a* is led via a non-return valve in the switching valve S12, which is switched over to passage in both directions as soon as the high pressure at the second clamping element 9*b* is reached through clamping. Thus a slight overlap again arises in the clamping function. As clamping elements 9*a*, 9*b*, those described in FIGS. 3*a* and 3*b* can be used. An advantage of these arrangements lies in the fact that the pipe cleaning apparatus stands still for safety reasons during this brief overlap time only, and that the progress of the movement is compulsorily controlled through a sequence control which is dependent on the position of the brake cylinders.

Figure 8:
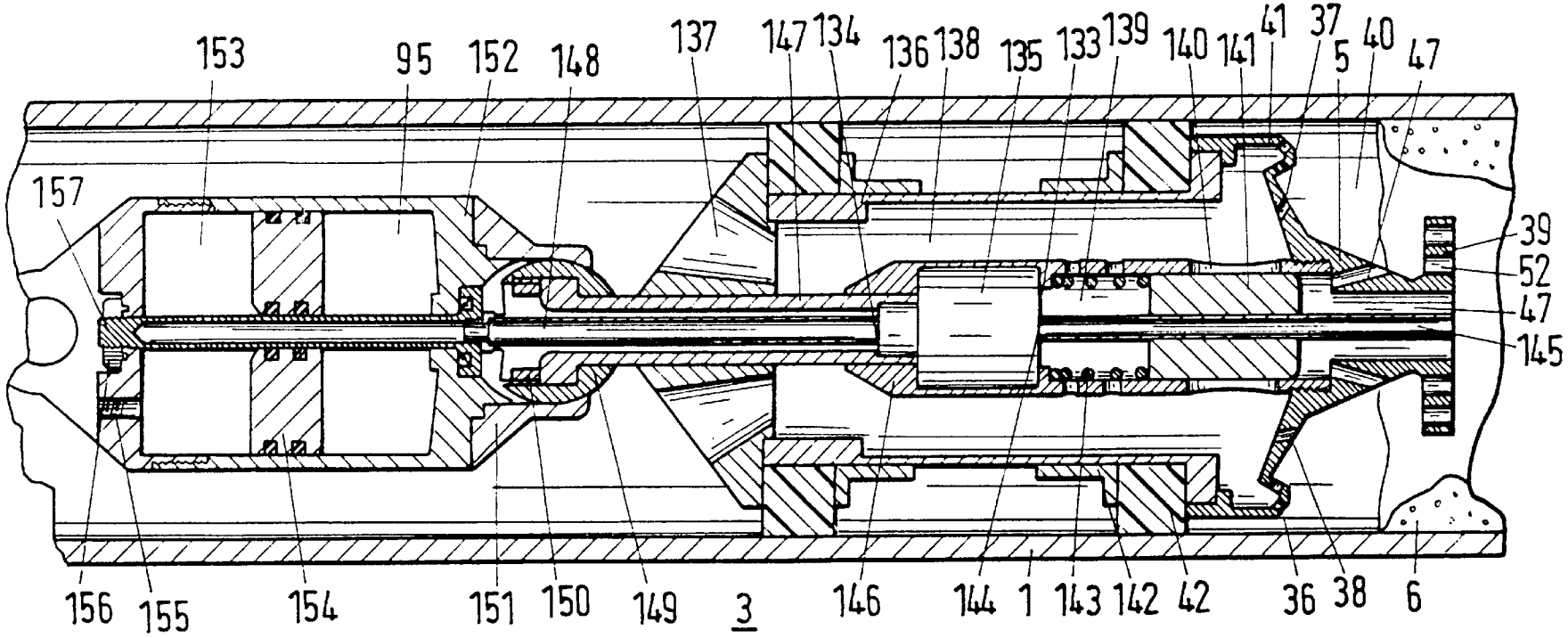
FIG. 8 is a schematic view of a shield with a cleaning head which can be used for different braking apparatuses, with a pressure reservoir for hydraulic clamping apparatuses adjoining the shield and a hydraulic motor being built into the shield for compensating leakage losses at the clamping apparatuses.

A further shield 3 with a pressure amplifier 135, a gas reservoir 95 and cleaning apparatus 5 is shown in FIG. 8. The cleaning unit 5 is integrated into the shield 3 on the downstream side. It consists substantially of nozzles 36, 37, 38 and an impact grid 39 mounted ahead of the nozzles which produces a cavity 40 towards the pipe wall 1 in which nozzle jets intended for the breaking up of the deposits 6 can be better kept under control. Some nozzles 36, 37 are directed towards the deposits 6 on the pipe wall. Other nozzles 38 are directed forwards towards the pipe axis 14 in order to suck detached particles into their liquid flow and in order to break up these particles at the housing or at the impact grid to a size which permits them to be flushed away in the forward direction by the passing liquid flow 7. The impact grid 39 should, however, also prevent a premature detachment of the deposits and thus preclude pipe blockage. The grid structure is achieved by bores 52. A crown 41 near the pipe wall with jets 36 prevents residual deposits from getting stuck in the region of the sealing packings 42. An outer housing part 136 carries the packings 42 which seal relative to the pipe wall 1 and are secured by holding rings 142. An inner housing 146 is connected to the outer housing part 136 via a front and a rear cover. Between the outer and inner housings there are large passage areas 137, 138 in order to supply the nozzles 36, 37, 38 with liquid without large pressure losses. Pressures of 20 to 30 bar across the shield 3 have proved sufficient as pressure difference to break up encrustations of paraffins with the nozzles. Higher pressures are possible, in which case it should be borne in mind that the braking devices 8 must be designed to be correspondingly strong.

Figure 11:
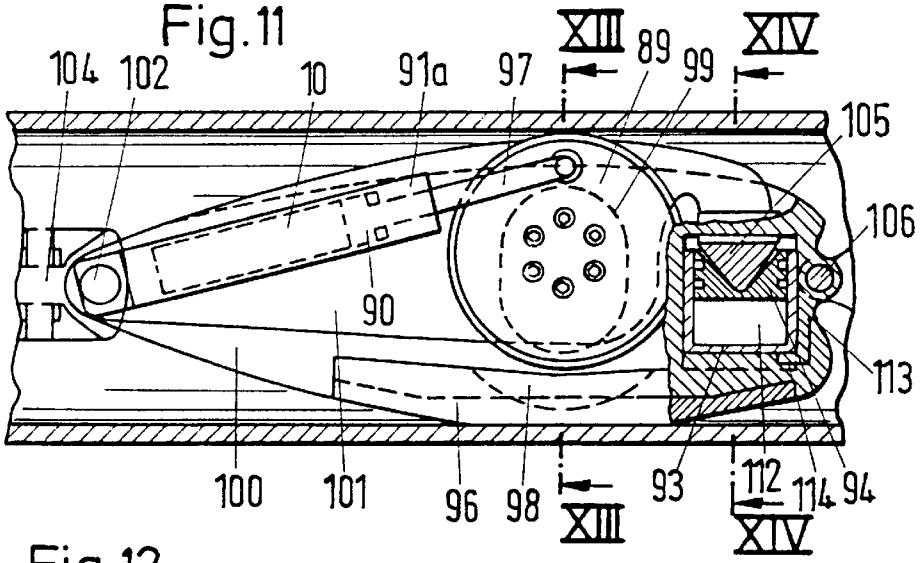
FIGS. 11, 12 are schematic longitudinal sections at right angles through a braking device with a co-moving roller which determines the speed of advance in that it is braked in the manner of a thrust crank drive by two shock absorbers displaced by 90°.
Figure 12:
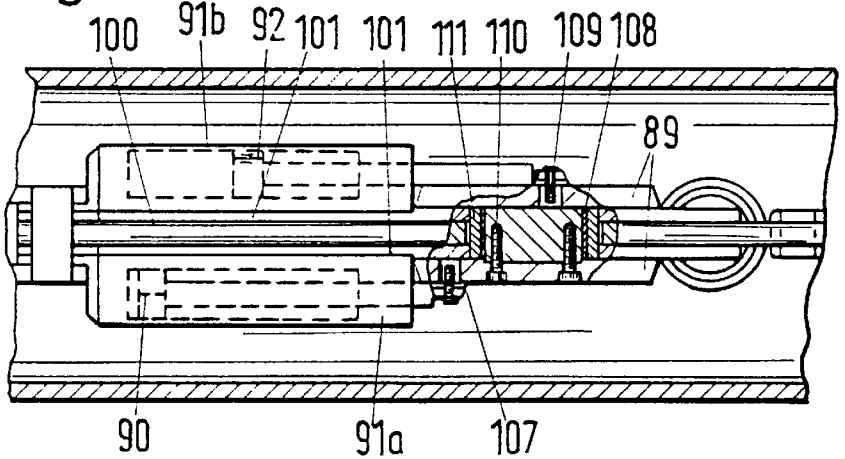
Figure 13:
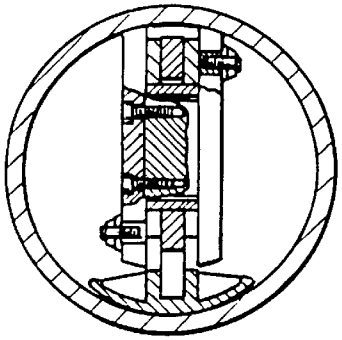
FIG. 13 is a schematic view of a cross-section through the roller in FIG. 11.
Figure 14:
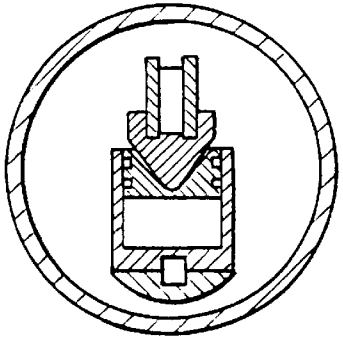
FIG. 14 is a schematic view of a cross-section through a clamping cylinder in FIG. 11.

A reverse flow device 141 is built into the shield 3 and frees a large additional through-flow cross-section when the flow direction is reversed. A piston 141 held under a bias force by a spring 143 is journalled in the inner housing 146 and opens a passage 140 and an orifice 47 when the direction of flow is reversed. For a normal flow in the advancing direction, the piston 141 is urged, in addition to the action of the spring 143, by the pressure difference at the shield, which reaches the rear piston surface through bores in the inner housing. This space 139 is bounded from behind by a commercially available pressure amplifier 135 whose connection 133 for the drive opens into this space, while a low pressure connection 144 in the form of a connection tube 145 protrudes with play through the piston 141 up to the orifice region 47 at the impact grid 39 in order to distribute there the flushing liquid which drives the pressure amplifier. The pressure amplifier 135 is a product Iversen HC2 of the Sherex Industries Ltd., 1400 Commerce Parkway, Lancaster, N.Y., USA. The pressure amplifier 135 has a high pressure outlet 134 at which the flushing liquid is present at a predeterminable raised pressure in order for example to compensate for leakage losses in a high pressure system during the cleaning of the pipe. In the present example the pressure acts via a hydraulic tube 148 and a connection tube 157 which is locked by a nut 156 on the liquid side 153 of a gas reservoir 95. The gas reservoir 95 is equipped with a partition piston 154 for the liquid 153 and forms a soft, strongly prestressed spring in order to exert a bias force on the clamping cylinder 93 via a connection 155 with an approximately constant pressure, i.e. independently of the piston stroke in the clamping cylinder. The top up delivery pressure of the pressure amplifier 135 lies somewhat lower than the predetermined gas pressure when the clamping cylinder is extended in order to only actually re-supply liquid in the case of leakage in the liquid part. Clamping cylinders 93 with a permanent clamping action will be discussed later in connection with FIGS. 9 and 11. An outer housing 152 of the gas reservoir 95 with a cover 151 forms the socket of a ball joint 149, which is secured via a holding ring 150 to the extension 147 of the inner housing 146. The pressure amplifier 135 is designed in such a manner that, through the pressure reversal during reverse flow in the pressure amplifier, a pilot valve briefly short circuits the liquid region 153 to the connection tube 145. In this manner the pressure in the liquid region can be relaxed to a substantially lower pressure than the gas cushion has at the abutment of the partition piston 154, and practically no more clamping takes place, which is desirable for rearward travel. This pressure lowering can at the same time be used to trigger auxiliary movements which are advantageous for a rearward travel.

Figure 9:
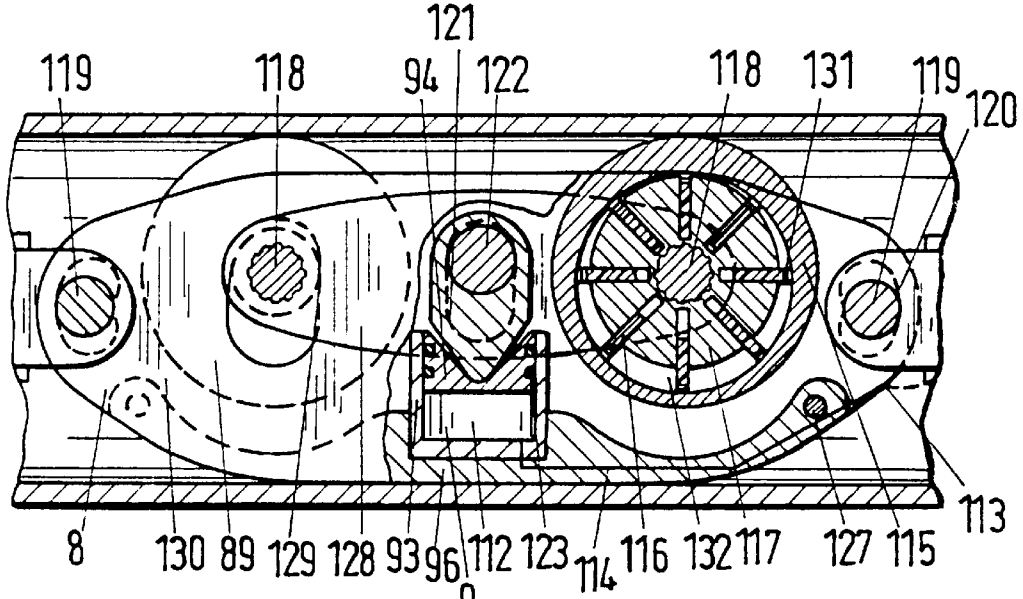
FIGS. 9, 10 are schematic longitudinal sections at right angles through a braking device with co-moving rollers which determine the speed of advance in that they drive a throttled volumetric pump.
Figure 10:
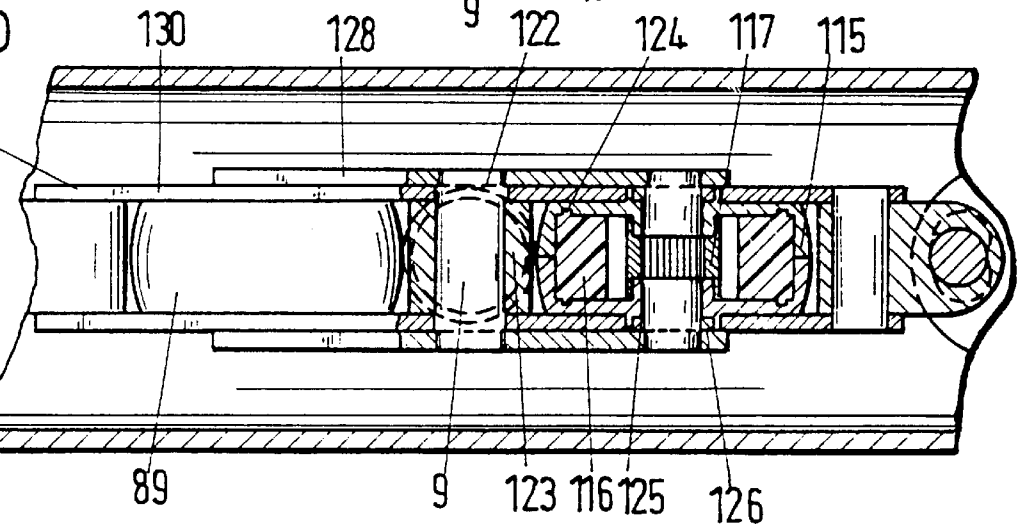

FIGS. 9 and 10 show a braking device 8 in which two rollers 89 connected by a bridge 128 are pressed radially by the bridge 128 against the pipe wall. The pressing is transmitted through a clamping cylinder 93, which is braced against the opposite side of the pipe by a sliding shoe 96. The clamping cylinder has a clamping piston 94 which transmits the pressing force to a displacement element 123 guided in guides 121, 129 and from there to the pivot axle 122 and to the bridge 128. The clamping cylinder 93 is connected via a high pressure liquid 112 and a hydraulic line 114 to a co-travelling gas reservoir 95 (FIG. 8), whose pressure is adjusted so that when the sliding shoe 96 glides along the pipe wall, the rollers 89, which are pressed outwards and simultaneously braked, form the clamping elements 9, which adhere to the pipe wall at their points of contact and determine the speed of advance. An outer housing 130 takes up the forces in the direction of the pipe axis and transmits them via pins 119 and lugs 120 to adjacent members. The sliding shoe 96 is secured with screws 127 to the outer housing as a part subject to wear. The hydraulic line 114 ends in a connection 113 for a hydraulic hose. The clamping force is transmitted by the axles 118 from the bridge 128 to the rollers 89. The rollers 89 are rotatably journalled as rotors 115 on the axles 118 and form a volumetric pump with a stator 117 anchored on the axle which slidingly supports vanes 116 in itself. Because secondary liquid 132 is continuously displaced and pressed by the vanes in a pressure region at an eccentric inner surface of the rollers 89 via restrictor locations 131 through the vanes 116 into a next chamber, a braking force arises at each roller which is determined by the characteristic of the restrictor locations 131. In the suction region there are recesses at the inner surface of the roller which facilitate a flowing back of the liquid. Shaft seals 126 seal off the bearings 125 of the rollers from the surroundings. The vanes 116 are additionally guided by noses in a peripheral groove. This type of a braking device 8 has the advantage that it is short and can be assembled to a multi-link chain which, when the links are each displaced by 90° with respect to one another, can also travel through sharp bends in the pipe. The required number of coupled braking elements 8 also depends on the difference pressure across the shield 3, if a certain speed of advance is not to be exceeded. The clamping force for the rollers 89 may be chosen only so large that the sliding shoes 96 do not block the shield 3.

Figure 16:
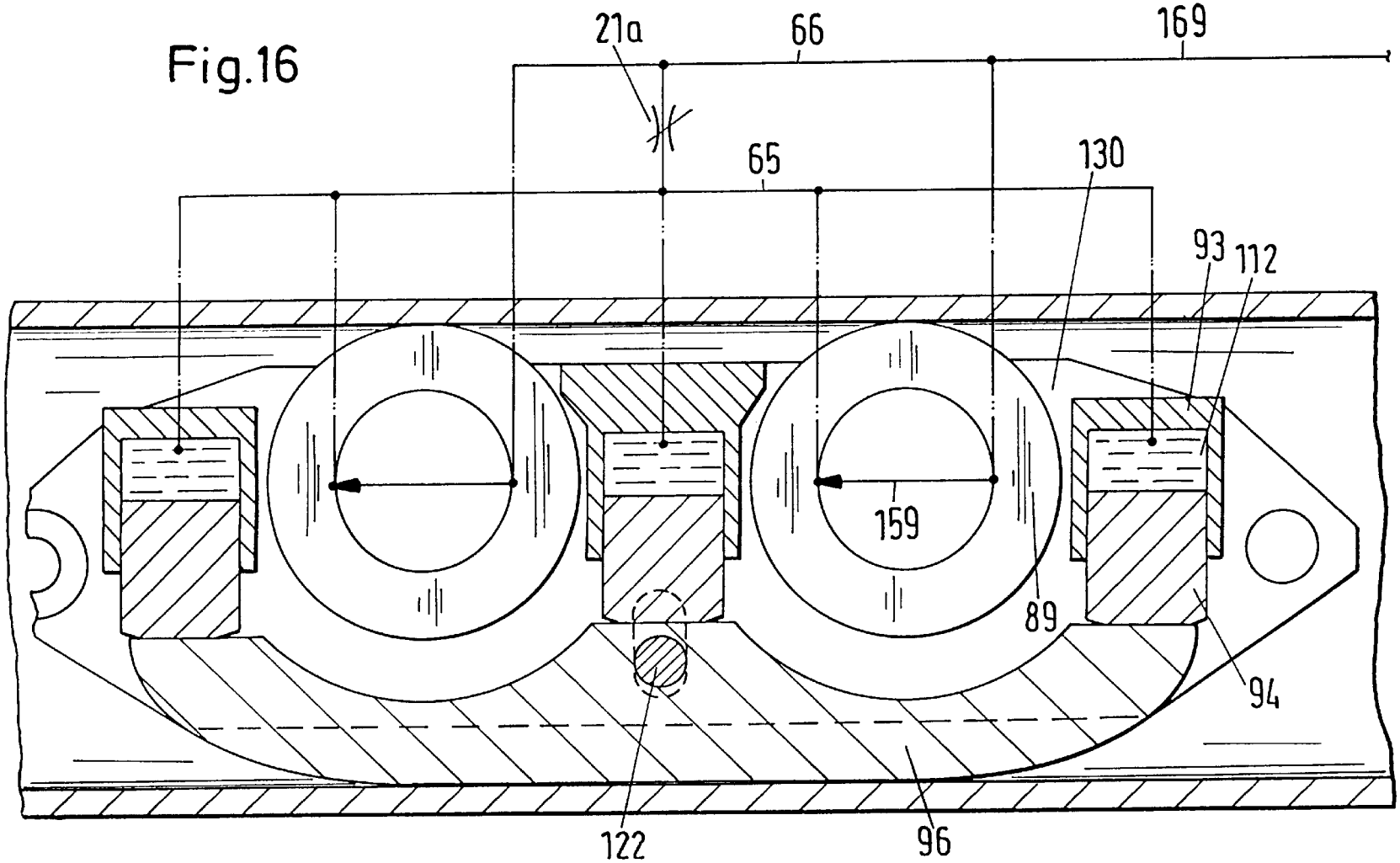
FIGS. 16, 17, 18 are schematic longitudinal sections through a pipe cleaning apparatus having a braking device which has a sliding shoe and contact pressure rollers, a central section which has a reservoir for hydraulic fluid, and with a shield which has a rotatable crown or ring with cleaning nozzles.
Figure 17:
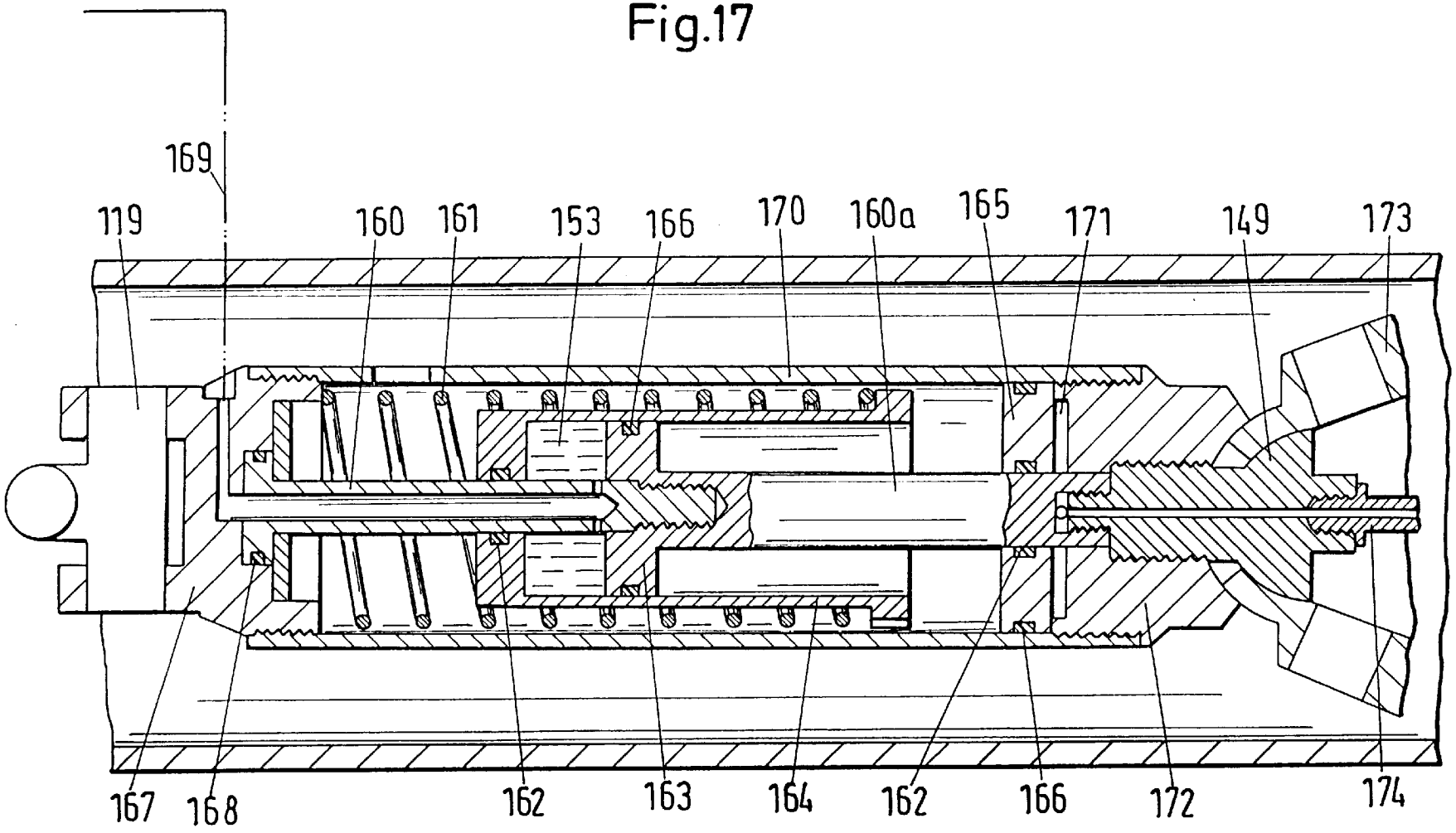
Figure 18:
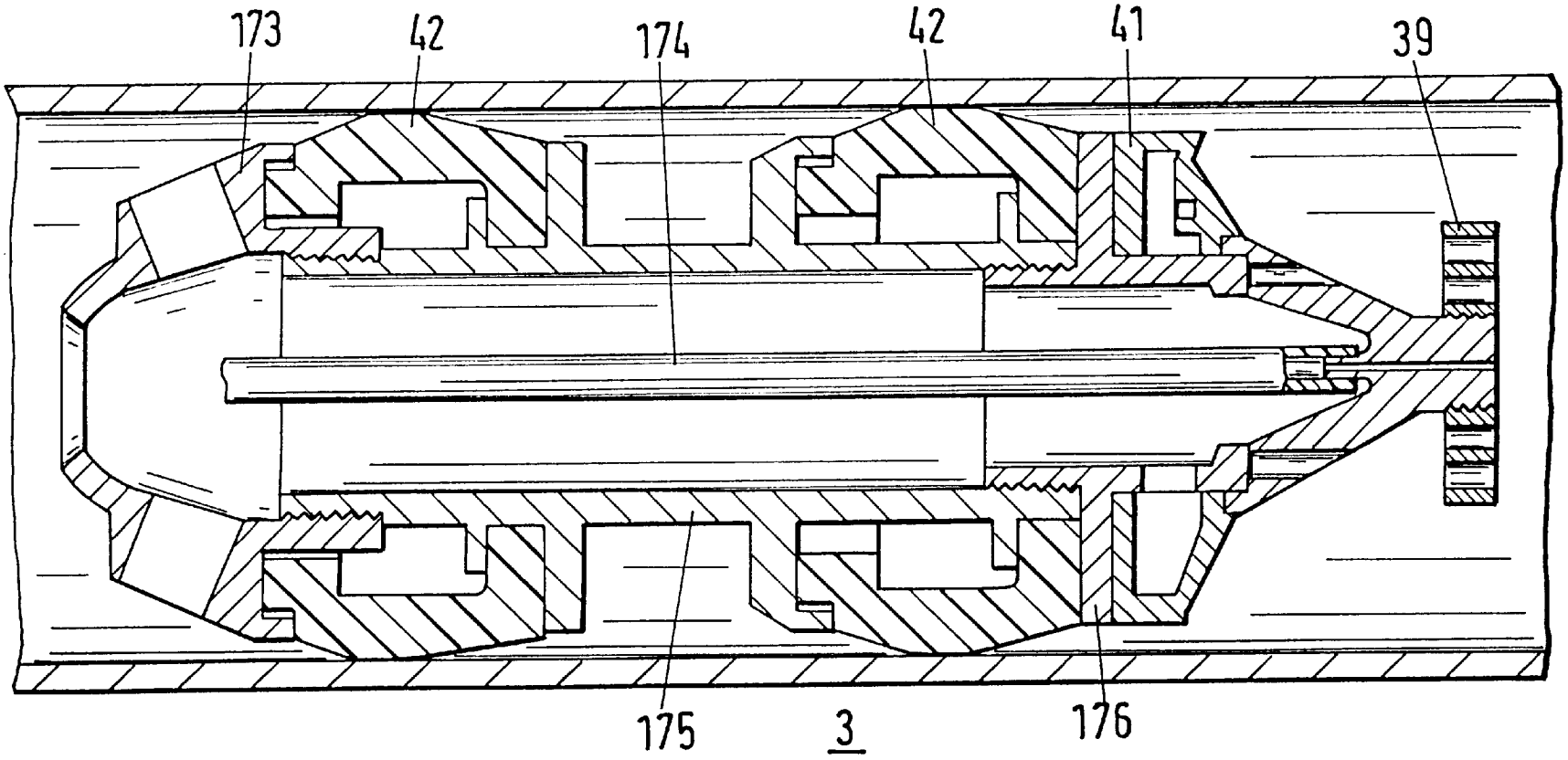

A further arrangement is shown in FIGS. 16, 17, and 18. The braking device in FIG. 16 has a sliding shoe 96 which contacts the tube 1 at the bottom and is secured via an axle 122 relative to the housing 130 of the braking device in the axial direction. Clamping pistons 94 of the clamping cylinders 93 connected to the housing 130 act on the sliding shoe 96 and simultaneously press the contact pressure rollers 89 journalled in the housing 130 against the tube 1 at the opposite side. The rollers 89 are arranged pair-wise and respectively form, with the housing, radial piston pumps which deliver into a high pressure line 65. Branch lines pass from the high pressure line 65 to the clamping cylinders 93 so that the clamping pistons 94 are exposed to the delivery pressure of the radial piston pumps 159. The quantity of liquid delivered by the radial piston pumps is relaxed via a restrictor 21*a*, the non-linear characteristic of which determines the delivery pressure of the pump and the contact pressure force at the clamping pistons 94. Connection lines 66 lead the liquid at the low pressure side after the restrictor 21*a* back to the suction side of the pumps. The fluctuations of the liquid volume in the clamping cylinders 93 are compensated by the pumps 159 and the restrictor 21*a*, and the corresponding deficit, or the excess at the low pressure side, is compensated by a liquid reservoir (FIG. 17) via a connection line 169. The hydraulic lines are schematically drawn out in FIG. 16 in order to better recognize the inner pipe arrangement.

In FIG. 17 a liquid reservoir in the form of a cylinder 164 is arranged in an outer housing 170, which is supported via a cover 167 and pins 119 on the braking device (FIG. 16), and is supported at the other end via a cover 172 and a ball joint on the shield (FIG. 18). The reservoir for the hydraulic liquid 153 consists of a piston which is connected to the housing in both directions via a piston rod 160, 160*a* and of a cylinder 164 movable thereto, which is pressed via a spring 161 in the direction towards the piston 163. The enclosed hydraulic liquid 153 thus always experiences a pressure component which is determined by the instantaneous spring force. Since the outer housing 170 has apertures towards the outside, a pressure prevails in the interior in the same way as in the pipeline 1, so that the pressure in the pipeline 1 is added as a second pressure component to the pressure in the hydraulic liquid 153. The transition to the connection line 169 takes place through the hollow piston rod 160. With this arrangement it is ensured that the pressure at the clamping pistons 94 is always greater than at the outer side when the apparatus is stationary. When starting from the stationary state, the rollers 89 are already in engagement with the pipe wall 1 and thus immediately start to pump. With rising speed the contact pressure in the clamping cylinders 93 increases and the braking force produced by the restrictor 21*a* rises until a balance is achieved with a tractive force from the shield 3.

A further piston 165 rides on the piston rod 160*a*, is sealed against the outer housing 170 and forms a pressure space 171. This pressure space 171 is connected via a connection line 174 to the space in front of the shield 3 in the vicinity of the impact grid 39. During forward travel the pressure in the inner housing is higher than at the impact grid 39 so that the piston 165 contacts the cover 172. During rearward travel, the pressure relationships are inverted and the piston 165 travels mechanically against the cylinder 164, compensates the bias force of the spring 161 and reduces the pressure at the low pressure side. The clamping pistons 94 yield with external forces, and the excess liquid flows to the reservoir. At the same time the rollers 89 lose their engagement and pumping no longer occurs. In this manner rearward travel without braking is possible by reversing the delivery direction in the pipeline. A similar effect is achieved when the inverse pressure conditions are used to control a valve which permits the reservoir to run down until the spring 161 has lost its effect. O-rings 168 and piston ring seals 162, 163, 166 serve for sealing.

The shield 3 in FIG. 18 has two packings 42 which seal relative to the pipe wall 1. An outer housing 173, 175 is terminated at the front end by a cover 176, which forms a bearing 202 for a rotatable crown 41 with cleaning nozzles. When the moments from the momentum at the cleaning nozzles are not compensated, a rotation can be generated by the crown 41. The cover 176 is continued forwardly by an attachment arm 201, which carries an impact grid 39. The connection line 174 leads through the whole shield up to the impact grid 39.

Figure 19:
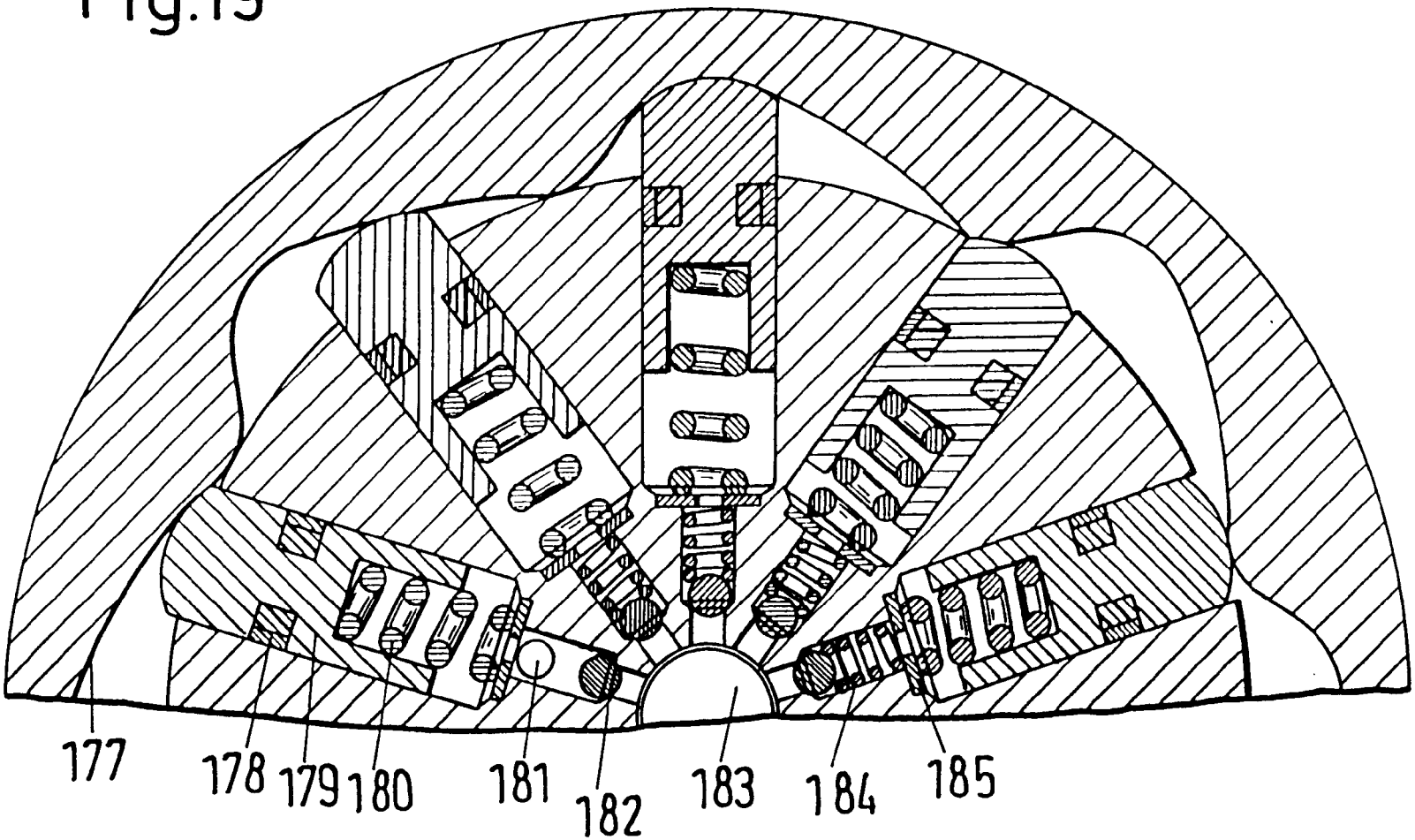
FIG. 19 schematically shows an enlarged section of the radial piston pump from FIG. 16.

FIG. 19 shows a radial piston pump with a running body 177, which is connected to the roller 89 (FIG. 16) and which has a wave-shaped internal contour. Star-like radial pistons 179 are arranged in a stationary inner part, which is fixedly connected to the outer housing 130 (FIG. 16), with the radial pistons following the inner contour of the rotating running body 177. The pistons 179 with seals 178 run in respective bores and are pressed outwardly by springs 180. When the pistons 179 are lifted, liquid is sucked in via a non-return valve 182 from an entry line 183 and is expelled on lowering of the piston via a further non-return valve 181 into a high pressure line. A ball-like closing body is supported at the non-return valve 182 at the inlet side by a spring 184, which contacts a retaining disc 185.

Figure 21:
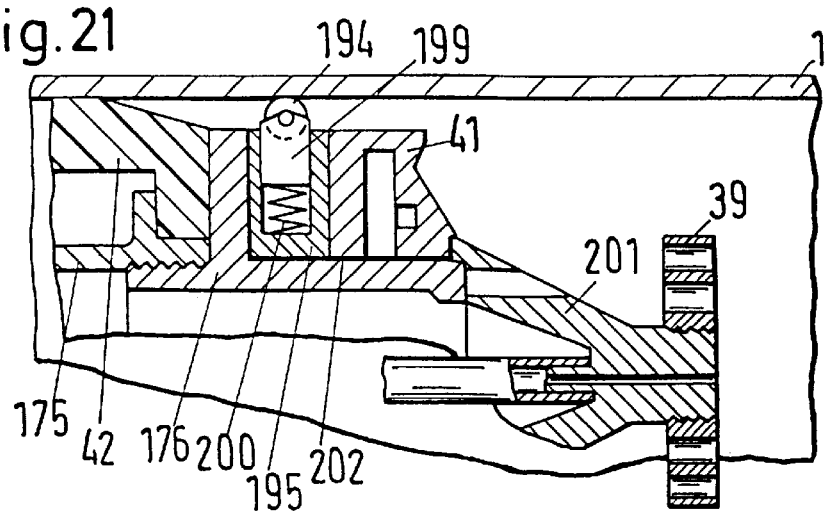
FIG. 21 schematically shows a variant of FIG. 18 in which the rotatable crown is guided during its rotational movement via resiliently supported rollers.
Figure 22:
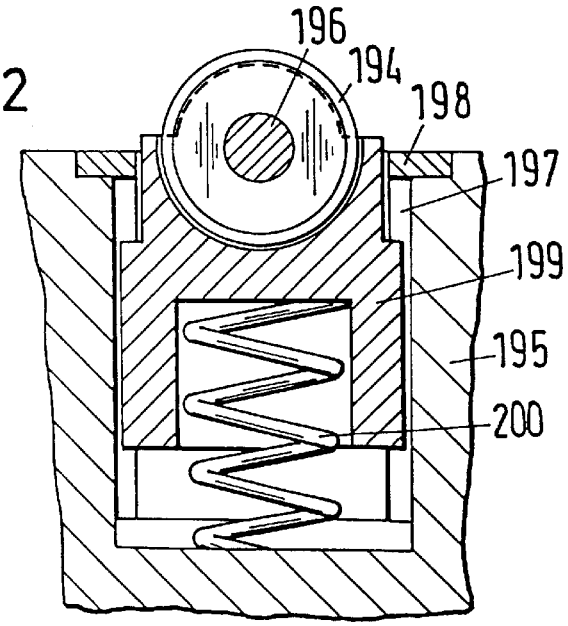
FIG. 22 schematically shows an enlarged section from FIG. 21 with a guide roller of this kind.
Figure 23:
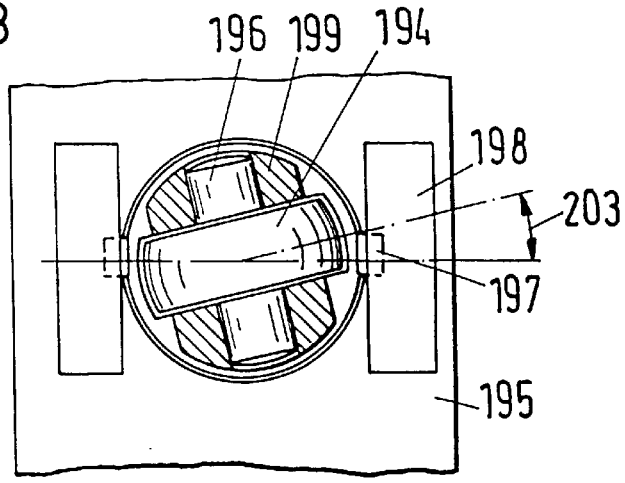
FIG. 23 schematically shows a plan view of a guide roller from FIG. 22.

In the FIGS. 21, 22, 23 the inner housing 176 is continued at the front packing 42 by an extended cover 176 in order to accommodate a support body 195 which rotates with the crown 41 in the intermediate space which is won in this way. The bearing 202 is correspondingly longer. In the carrying body 195 there are elastically supported guide rollers which have a slightly inclined position relative to the longitudinal axis of the pipe 1 and thus run under pressure on a helical path in the tube in order to give the crown 41 a predetermined rotation. The cleaning nozzles which rotate with the crown cut into the deposits in the pipeline in helical manner, and radial cuts can be produced with additional non-rotating nozzles which cut free and release rhomboid-shaped bodies in the deposits. A precondition for a good cleaning action is that the dwell time of the nozzle jets is as constant as possible, which is achieved by the braking device.

It is evident from FIGS. 22 and 23 that the rollers 194 are journalled by a pin 196 in a cylindrical carrying body 199. The carrying body 199 is displaceable in a bore with guide grooves 197 and secured against rotation. A pre-stressed contact pressure spring 200 presses the carrier body 199 and the guide roller 194 outwardly against the pipe wall 1. The outward movement of the roller 194 is restricted by safety jaws 198. The inclined position 203 of the running direction of the roller 194 relative to the longitudinal axis of the pipeline can be varied by providing several guide grooves 197 for a counter-shoulder on the carrier body 199 or by providing a selection of carrier bodies 199 with counter-shoulders orientated differently relative to the running direction of the roller 194.

Figure 20:
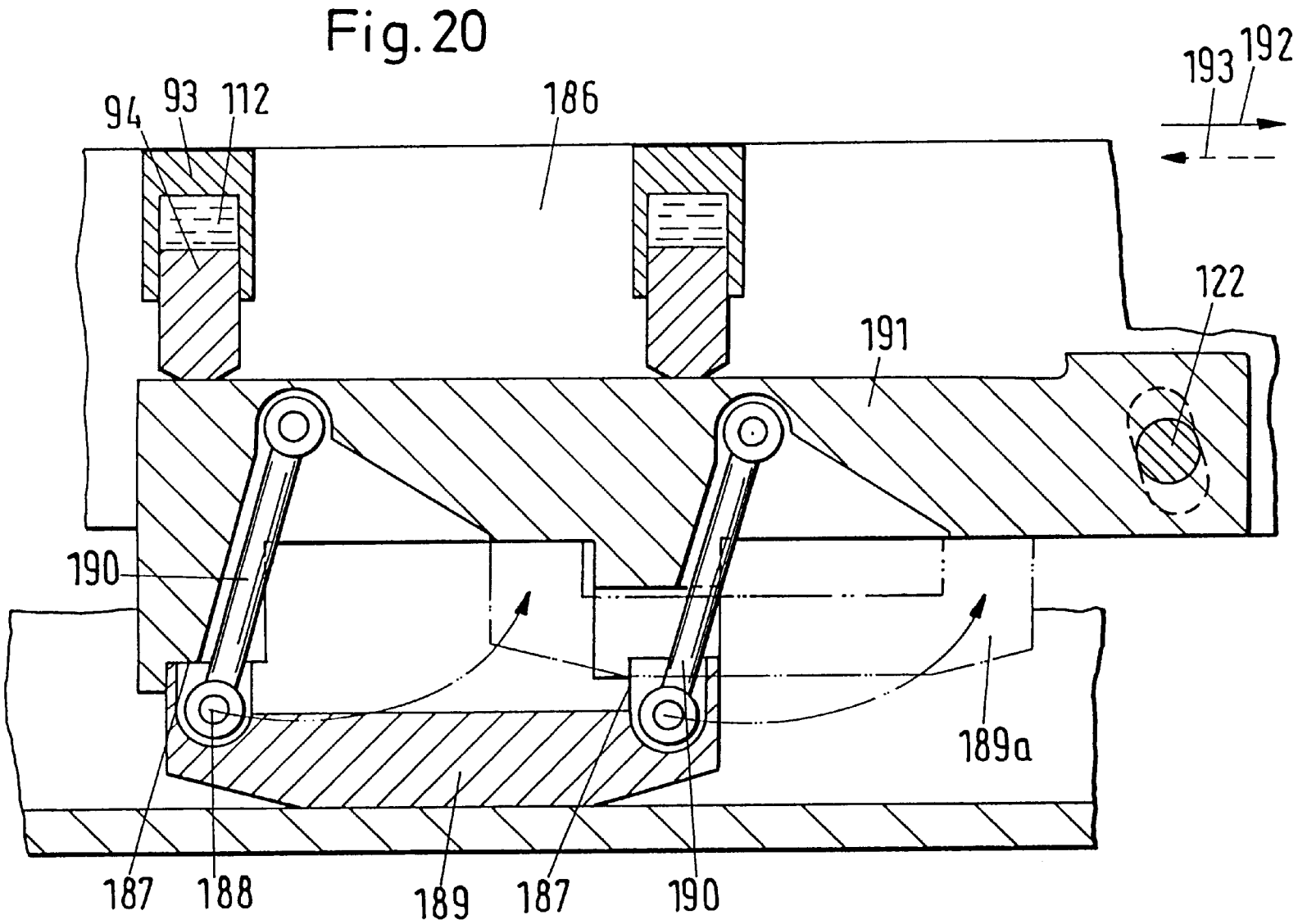
FIG. 20 schematically shows an enlarged section for a friction shoe which is mounted on pivot arms and which necessarily folds in during rearward travel as a result of the wall friction.

In FIG. 20 a movable friction shoe 189 is shown which, during forward movement 192, contacts abutments 187 of the carrier body 190. The friction 189 shoe is connected via pivot arms 190 and bearings 188 to the carrier body 191 and forms a parallelogram. The abutments 187 are set back somewhat in the axial direction relative to the highest radial deflections (dead center points) so that rotation of the arms through the dead center points during forward travel is avoided reliably under the radial contact pressure forces of the clamping pistons 94. During the forward movement, the friction shoe 189 produces a frictional force which depends on the pressure in the clamping cylinders 93 and is transmitted via an axle 122 from the carrier body 191 to the outer housing 186. During a rearward movement 193 a frictional force arises in this position in the opposite direction at the frictional shoe 189. The frictional shoe remains stationary and the liquid 112 in the clamping cylinders 93 is partly displaced into a non-illustrated pressure reservoir so that the outer housing 186 on the pivot arms 190 is lifted away via the stationary friction shoe 189 until a "dead center point" is reached in which the clamping pistons 94 support the full backward movement of the friction shoe 189. As the stroke of the clamping piston 94 is smaller than the radially inward movement of the friction shoe up to and into a retracted position 189*a,* the friction shoe 189 is simply dragged along with loose engagement during rearward travel 193. During rearward travel, only a small pressure difference is necessary over the whole pipe cleaning apparatus, apart from this initial phase. At the same time the friction points of the braking device are carefully treated. If contact pressure rollers with radial piston pumps are provided at the opposite side of a friction shoe 93 of this kind, the pumps need only turn backwards in the initial phase, until the friction shoe 189 has moved out of engagement. They are treated in a careful manner during the actual return journey. A similar action is also achieved with a friction shoe which is guided on a wedge track which, relative to the axis of the pipeline, merges from a parallel track into a track inclined to the axis.

A further braking device 8 is described in FIGS. 11, 12, 13 and 14. It prevents an uncontrolled advance of the cleaning apparatus 5 in that a thrust crank drive is driven by the rotation of the rollers 89, which are pressed against the inner pipe wall 1 by a clamping cylinder 93. This drive consists of two hydraulic brake cylinders 91*a,* 91*b* displaced by 90°, the piston rods 97 of which are directly connected to the rollers 89 with a displacement of 90° by means of an attachment 109. Bearings 107 built into the rollers 89 enable the driving action of the thrust crank, which forces a secondary liquid 10 through restrictor locations 92 by means of the pistons 90 and thus respectively achieves the greatest volume flow at the dead center of the first cylinder 91*a* and the greatest braking effect with the second cylinder 91*b*.

The double roller 89 is journalled in a sliding bearing 108 whose bearing bush 111 is pressed into two support bodies. These two support bodies are mounted on a support body 100 for pivotal movement to both sides about a common axle 102. The support body 100 has a cut-out 99 in the shape of an elongate hole in the region of the bush 111. A clamping cylinder 93 produces the required pressing force through a liquid 112, and this force is further transmitted via a piston 94 into a cone 105 and hence into two pivotal support bodies 101 and presses the double roller 89 screwed together with screws 110 against the pipe wall 1 via the bush 111 with the bearing 108. The reaction force corresponding to the pressing force of the roller is transmitted via a common axle 102 and via the clamping cylinder 93 built into the support body 100 into a sliding shoe 96 with cut-out 98 lying opposite to the roller, which is pressed with the corresponding normal force against the inner pipe wall. This leads to a three-point support through the axial extension of the sliding shoe together with the pressed on roller and prevents the entire unit from tilting away from the pipe axis. It also permits smaller dimensions of the thrust crank unit due to the additional sliding friction.

In order to increase the nozzle pressure required for the cleaning, this braking device 8 can be connected to further, like, braking device elements 8 by means of joint elements 104 which are secured to axles 106. For a higher pump power of the liquid flow used for the cleaning, this produces the same speed of advance with increased cleaning pressure in the nozzles 36, 37, 38 of the shield 3.

Figure 15:
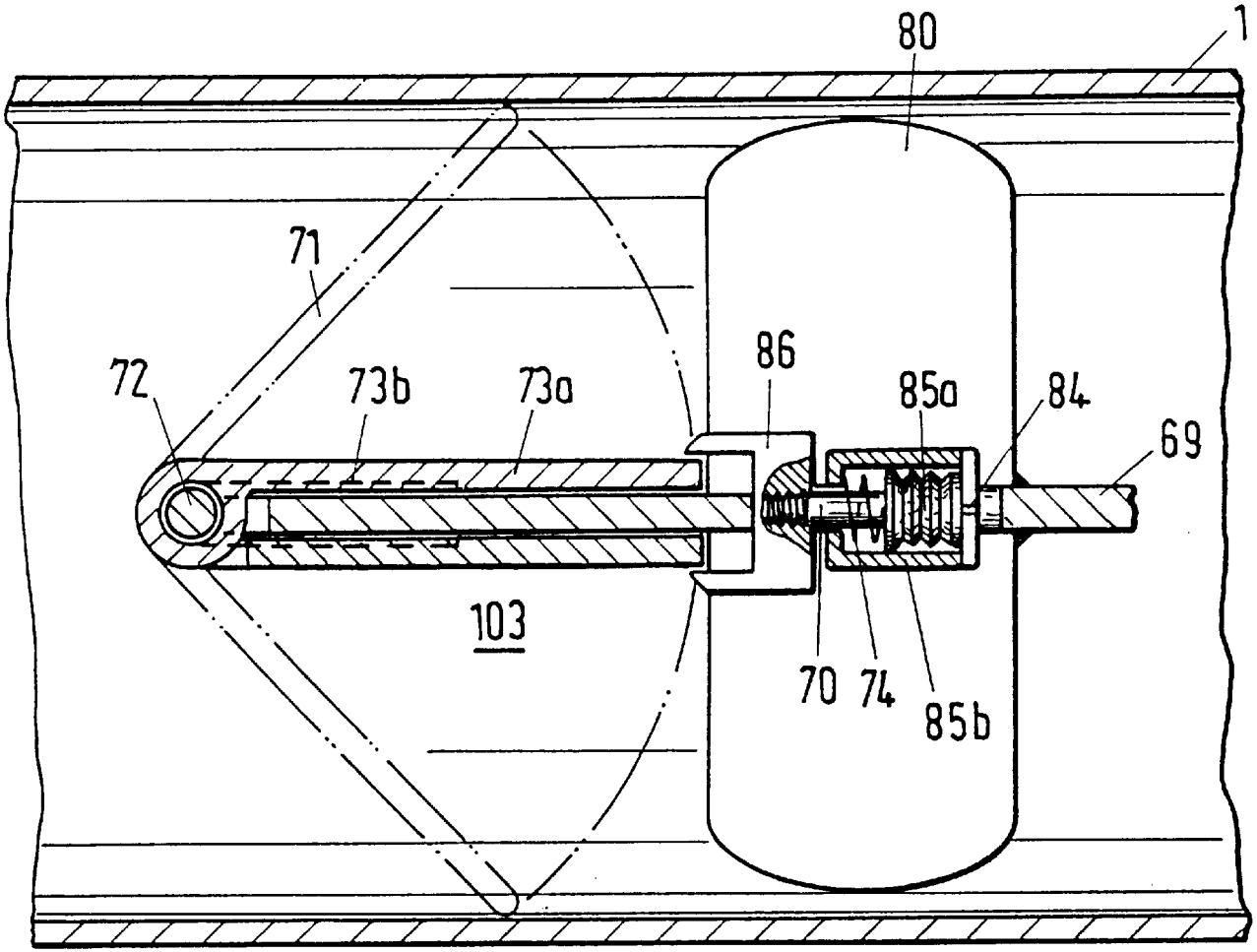
FIG. 15 is a schematic view of a return trip shield which can be pivoted outwardly in order to pull a cleaning apparatus back when the flow direction is reversed.

FIG. 15 describes a return trip shield 103 which can cooperate with the shield 3 as is described in FIG. 8. When the flow is reversed, the flow resistance at the shield 3 is reduced through a reverse flow device 141. At the same time it would be desirable to have a return trip shield 103 at the other end which pulls back the released braking devices 8 and the shield 3. It is the pulling action which prevents a wedging of the elements at curves in the pipe. Accordingly, the return trip shield 103 consists of a support plate 69 which is arranged centrally with play in the pipe 1 and is held at this center by lateral guide fins 80. A hinge pin 72 at which two flap vanes 73*a* are journalled as in a butterfly valve is connected to the support plate 69, with the elliptical flap vanes being able to attain only an acute extended position 71 with respect to the pipe axis, whereupon the pipe cross-section is largely closed off. The greatest play with respect to the pipe wall is present in the region of the ends of the hinge pin 72, while the ends of the flap vanes can slide over obstacles such as welding seams. The pressure at the flap vanes 73*a,* less the friction of the flap vanes against the pipe wall, is available as a pulling force. Since the braking elements are not in operation during the backward trip due to the lack of the required clamping, the pulling force via the return trip shield 103 need actually only be so large that the friction on the elements lying behind it, which also experience a pulling action due to the passing flow, can be compensated reliably.

During the advancing movement of the pipe cleaning apparatus, the flap vanes 73*a* are blocked at the support plate 69 by a pawl 86. A metal bellows 85*a* with piston rod 70 standing under pressure, which is arranged in a housing 85*b*, presses the pawl 86 into its abutment position against the force of a restoring spring 74. The flap vanes 73*a* are not released until the pressure in the metal folding bellows 85*a*, which is linked to the flow reversal, sinks, so that they can move into the flow with the assistance of a spreading spring lying in contact with grooves 73*b*. The metal folding bellows 85*a* is held under pressure via a pressure connection 84. Its use as a setting member is favored by the fact that only short strokes are necessary, that it can be made small due to the low force requirements, and that no seals are present which can produce friction or leakage as trouble factors.

What is claimed is:

1. Pipe cleaning apparatus for oil and gas pipelines having deposits on a wall of the pipe, the apparatus being pushed through the pipeline by a liquid flow for cleaning purposes, the apparatus comprising a shield which forms at least one aperture permitting passage of liquid from the liquid flow to thereby generate a predetermined flow resistance in the pipeline, a braking device coupled to the shield, a cleaning apparatus at a front end of the shield, the braking device having at least one clamping element adapted to momentarily adhere to the pipe wall while moving relative to the braking device so that the relative movement of the clamping element generates a secondary liquid flow, and at least one throttling device for braking the secondary liquid flow to thereby determine a relative speed between the shield and the pipe wall.

2. Pipe cleaning apparatus in accordance with claim 1 wherein the at least one clamping element has at least one roller which is journalled in the braking device and presses radially against the pipe wall, the rotation of the at least one roller causing the secondary liquid flow.

3. Pipe cleaning apparatus in accordance with claim 2 including a first hydraulic actuator which can be moved by the rotation of the roller for generating the secondary liquid flow by displacing the secondary liquid between a piston and a cylinder of the hydraulic actuator and braking it by means of the throttling device.

4. Pipe cleaning apparatus in accordance with claim 3 including a second hydraulic actuator which is displaced by 90°, moved by the roller, and drives the secondary liquid through the throttling device for achieving the greatest volume flow at a dead center of the first hydraulic actuator and the greatest braking action with the second hydraulic actuator, respectively.

5. Pipe cleaning apparatus in accordance with claim 2 including a volumetric pump which generates the secondary flow and is driven by movement of the at least one roller, and wherein the throttling device brakes the secondary liquid flow generated by the volumetric pump.

6. Pipe cleaning apparatus in accordance with claim 2 including a sliding shoe connected to the braking device and arranged opposite to the at least one roller for generating a sliding friction force against the pipe wall, a force at the sliding shoe normal to the pipe wall corresponding to a pressing force exerted by the roller.

7. Pipe cleaning apparatus in accordance with claim 2 including an arrangement biasing the at least one roller relative to the braking device, the arrangement comprising a co-travelling pressure reservoir and a high pressure cylinder having a piston exposed to the pressure of the pressure reservoir.

8. Pipe cleaning apparatus in accordance with claim 2 including a high pressure cylinder and a cooperating piston biasing the roller relative to the braking device against the pipe wall, and wherein the pressure of the secondary flow liquid upstream of the throttling device acts on the cooperating high pressure cylinder and piston.

9. Pipe cleaning apparatus in accordance with claim 8 including a co-travelling reservoir for secondary liquid connected to a low pressure side of the throttling device in order to compensate for leakage of secondary liquid and in order to define a relatively lower pressure of the secondary liquid flow downstream of the throttling device.

10. Pipe cleaning apparatus in accordance with claim 9 including an arrangement which generates a spring force subjecting the secondary liquid in the reservoir to a minimum pressure, and wherein a second force acts on the reservoir which is proportional to a pressure difference over the pipe cleaning apparatus in the pipeline.

11. Pipe cleaning apparatus in accordance with claim 10 including an arrangement dissipating the pressure of the secondary liquid in the reservoir during rearward travel of the pipe cleaning apparatus with an opposing pressure difference so that no radial contact pressure force is generated during rearward travel.

12. Pipe cleaning apparatus in accordance with claim 10 wherein the sliding shoe compulsorily adopts a smaller radial spacing from the braking device during rearward than during forward travel.

13. Pipe cleaning apparatus in accordance with claim 1 wherein the braking device has at least two axially displaced clamping elements with radially outwardly deployable clamping shoes, and including a braking cylinder and a cooperating braking piston which axially movably connect the clamping shoes to permit a stepwise braked movement of the shield through throttling of the displaced secondary liquid.

14. Pipe cleaning apparatus in accordance with claim 1 including a hydraulic motor built into the shield in the passing liquid flow to thereby drive a liquid pump for auxiliary movements of the pipe cleaning apparatus.

15. Pipe cleaning apparatus in accordance with claim 1 wherein the shield has a plurality of nozzles at its front end generating mutually displaced fluid jets which cut the deposits into pieces.

16. Pipe cleaning apparatus in accordance with claim 15 wherein the shield has an impact grid at the front end ahead of the nozzles which occupies only a portion of the pipe cross-section and which is placed sufficiently ahead of the nozzles to form a cavity for pieces of deposits cut loose from the pipe wall to thereby break apart the pieces with the help of the impact grid and mix them with the passing liquid flow.

17. Pipe cleaning apparatus in accordance with claim 16 wherein the nozzles are distributed as groups on circles concentric to one another, jets of fluid from the nozzles having at least one direction component parallel to an axis of the pipe and oriented forwardly in order to convey off the pieces of deposits prior to the arrival of the shield.

18. Pipe cleaning apparatus in accordance with claim 17 wherein fluid jet impulses from the nozzles at the shield substantially cancel each other as a sum of moments in a peripheral direction.

19. Pipe cleaning apparatus in accordance with claim 15 wherein the shield has a projecting crown near the pipe wall with a plurality of nozzles for detaching residual deposits from the pipe wall in order to form a free passage for the shield.

20. Pipe cleaning apparatus in accordance with claim 1 wherein the front end of the shield is rotatable relative to a sealing part.

21. Pipe cleaning apparatus in accordance with claim 20 including at least two resiliently journalled support rollers connected to the front end so that they roll off in a helical manner in the pipeline and impart rotation to the front end.

22. Pipe cleaning apparatus in accordance with claim 1 including a reverse flow device on the shield which frees an additional passage area when the flow is reversed with respect to the liquid flow, and a reverse trip shield at a rear end of the pipe cleaning apparatus which forms a substantially greater flow resistance when the flow is reversed in order to drag the pipe cleaning apparatus in the reverse direction.

23. Pipe cleaning apparatus in accordance with claim 1 wherein the shield is adapted to free a relatively larger cross-section in the pipe of deposits on the pipe wall with a flow reversal, and wherein the flow reversal substantially relieves the clamping force exerted by the clamping elements of the braking device.

24. Pipe cleaning apparatus for crude oil and gas pipelines having deposits adhering to a wall of the pipe, the apparatus being pushed through a pipeline by a liquid flow for cleaning purposes, the apparatus having a shield which forms at least one aperture for a passing liquid flow for restricting a speed of advance to a relatively low value by generating a predetermined flow resistance, a pressure difference across the shield being sufficient to drive a cleaning device which removes the deposits from the pipe wall and transfers them to the passing liquid flow, the shield being coupled to a braking device including at least one clamping element for momentarily securing the braking device to the pipe wall, the clamping element transmitting a braking force, and an arrangement which determines the advance of the apparatus relative to the pipe wall by generating a secondary liquid flow via a throttling device using relative movement between the clamping element and the braking device.

25. Pipe working apparatus for use inside pipelines, which apparatus is pushed through the pipeline by a fluid flow in a downstream direction, wherein the apparatus has a working head which permits a fluid flow past it and which has a speed of advance which is less than a speed of the fluid in the pipeline upstream of the working head, to form, with a predetermined flow resistance, a pressure difference across the working head which is sufficient to drive the working head in a forward direction, the working head being coupled to a braking device which momentarily adheres to the pipe wall with at least one clamping element, and wherein the clamping element transmits a braking force which determines the speed of advance, the braking force being generated by a secondary liquid flow via a throttling device by using relative movement between the clamping element and the braking device.

* * * * *